US008723731B2

(12) United States Patent
Tatarnikov et al.

(10) Patent No.: US 8,723,731 B2
(45) Date of Patent: May 13, 2014

(54) COMPACT CIRCULARLY-POLARIZED ANTENNA WITH EXPANDED FREQUENCY BANDWIDTH

(75) Inventors: Dmitry Tatarnikov, Moscow (RU); Anton Stepanenko, Dedovsk (RU); Andrey Astakhov, Moscow (RU); Vladimir Philippov, Moscow (RU)

(73) Assignee: Topcon GPS, LLC, Paramus, NJ (US)

( * ) Notice: Subject to any disclaimer, the term of this patent is extended or adjusted under 35 U.S.C. 154(b) by 602 days.

(21) Appl. No.: 12/563,218

(22) Filed: Sep. 21, 2009

(65) Prior Publication Data

US 2010/0073239 A1 Mar. 25, 2010

Related U.S. Application Data

(60) Provisional application No. 61/194,169, filed on Sep. 25, 2008.

(51) Int. Cl.
*H01Q 1/38* (2006.01)
*H01Q 21/26* (2006.01)

(52) U.S. Cl.
USPC ..... 343/700 MS; 343/797; 343/833; 343/872

(58) Field of Classification Search
USPC ..... 343/700 MS, 702, 795, 797, 807, 833, 343/872
See application file for complete search history.

(56) References Cited

U.S. PATENT DOCUMENTS

| | | | | |
|---|---|---|---|---|
| 3,811,127 | A | 5/1974 | Griffee et al. | |
| 4,878,062 | A * | 10/1989 | Craven et al. | 343/872 |
| 5,005,019 | A * | 4/1991 | Zaghloul et al. | 343/700 MS |
| 5,418,544 | A | 5/1995 | Elliot | |
| 5,650,788 | A * | 7/1997 | Jha | 343/700 MS |
| 6,618,016 | B1 | 9/2003 | Hannan et al. | |
| 6,697,019 | B1 * | 2/2004 | Hyuk-Joon et al. | 343/700 MS |
| 2003/0043074 | A1 | 3/2003 | Bhattacharyya et al. | |
| 2003/0052825 | A1 | 3/2003 | Rao et al. | |
| 2007/0188398 | A1 | 8/2007 | Mohuchy et al. | |
| 2007/0241983 | A1 | 10/2007 | Cao et al. | |

OTHER PUBLICATIONS

International Search Report corresponding to International Application No. PCT/IB2009/006922, filed Sep. 23, 2009 (5 pages).
Written Opinion of the International Searching Authority corresponding to International Application No. PCT/IB2009/006922, filed Sep. 23, 2009 (10 pages).

* cited by examiner

*Primary Examiner* — Michael C Wimer
(74) *Attorney, Agent, or Firm* — Wolff & Samson, PC

(57) ABSTRACT

Disclosed is a circularly-polarized antenna comprising a flat conducting ground plane, a radiator, and an excitation system disposed between the radiator and the ground plane. The radiator comprises a plurality of conducting segments separated from each other by a first dielectric medium and separated from the ground plane by a second dielectric medium. The plurality of conducting segments are symmetrically disposed about an antenna axis of symmetry orthogonal to the ground plane. The excitation system comprises a flat conducting exciter patch and four excitation sources with phase differences of 0, 90, 180, and 270 degrees. The excitation sources are generated on two orthogonal printed circuit boards.

44 Claims, 23 Drawing Sheets

FIG. 9C
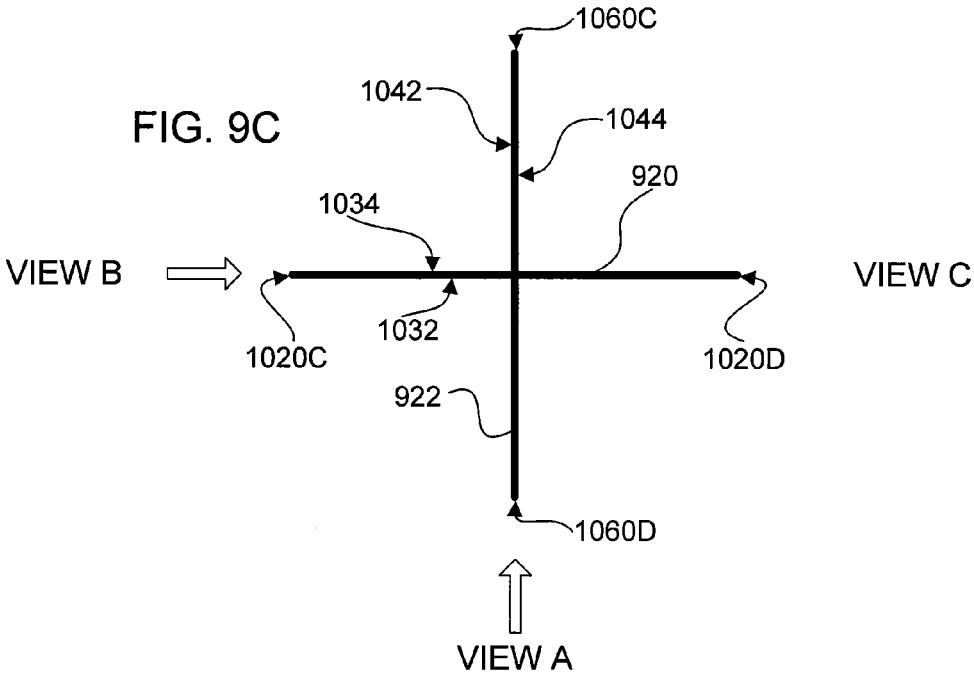
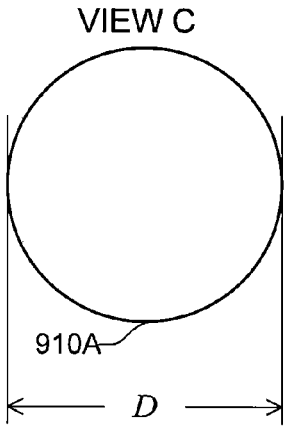
FIG. 9D
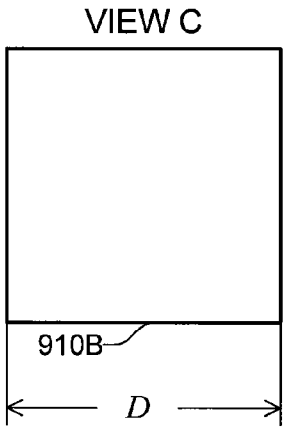
FIG. 9E
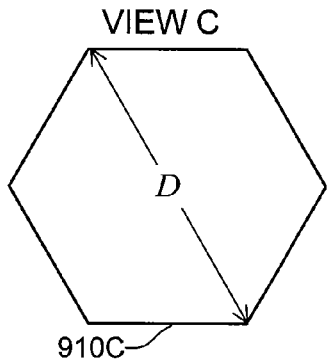
FIG. 9F

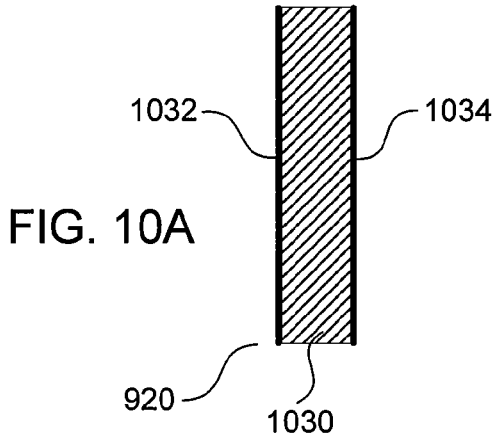
FIG. 10A
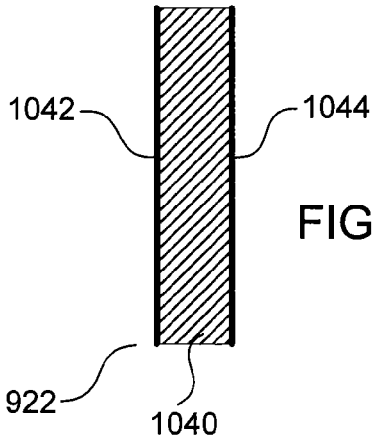
FIG. 10B
FIG. 10C
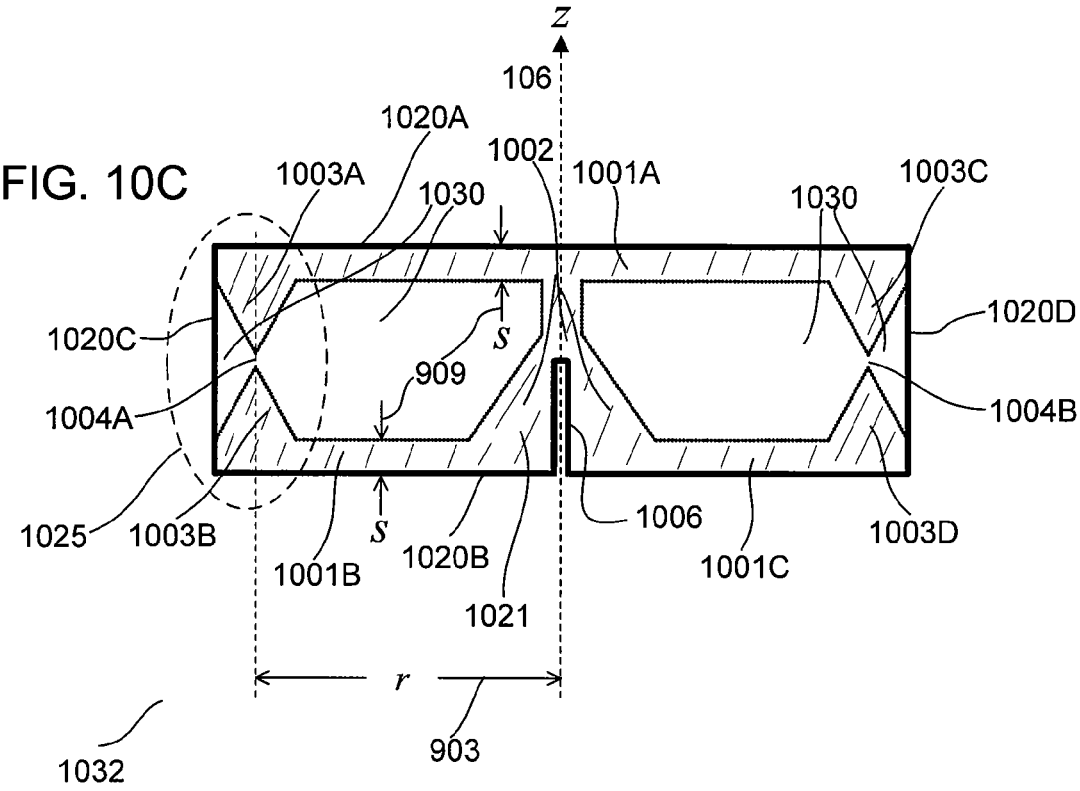

1042

VIEW C

950

COMPACT CIRCULARLY-POLARIZED ANTENNA WITH EXPANDED FREQUENCY BANDWIDTH

This application claims the benefit of U.S. Provisional Application No. 61/194,169 filed Sep. 25, 2008, which is incorporated herein by reference.

BACKGROUND OF THE INVENTION

The present invention relates generally to antennas, and more particularly to compact circularly-polarized antennas with expanded frequency bandwidth.

A wide range of consumer, commercial, industrial, and military applications utilize global navigation satellite systems (GNSSs), such as the Global Positioning System (GPS), for precision timing and location measurements. For specific applications, a variety of GPS receivers are available. A key component of a GPS receiver is the antenna, which is designed to meet user-specified mechanical and electromagnetic specifications. Mechanical specifications include size, weight, and form factor. Electromagnetic specifications include resonant frequency, bandwidth, sensitivity, gain, antenna pattern, and polarization. Cost and ease of manufacturing are also important considerations in antenna design.

One example of an adaptive antenna for detecting circularly-polarized radiation is described in U.S. Pat. No. 6,618,016. It can be dynamically programmed for multiple antenna patterns. This versatility is achieved, however, with a mechanically complex, eight-element design and a complicated excitation system. For some applications, furthermore, the bandwidth and azimuthal uniformity of the antenna pattern are not adequate.

What is needed is a light weight, compact antenna that receives circularly-polarized radiation, has low sensitivity to multipath reception, has a high bandwidth, and has an azimuthally-uniform antenna pattern. An antenna that is easy to manufacture at low cost is desirable.

BRIEF SUMMARY OF THE INVENTION

In an embodiment of the invention, a circularly-polarized antenna comprises a flat conducting ground plane, a radiator, and an excitation system disposed between the radiator and the ground plane. The radiator comprises a plurality of conducting segments separated from each other by a first dielectric medium and separated from the ground plane by a second dielectric medium. The plurality of conducting segments are symmetrically disposed about an antenna axis of symmetry orthogonal to the ground plane.

The excitation system comprises a flat conducting exciter patch and four excitation sources with phase differences of 0, 90, 180, and 270 degrees. The excitation sources are disposed on two orthogonal printed circuit boards. An excitation source is generated at a gap between two metallized conductors. There are two antiphase excitation sources on each printed circuit board. On each printed circuit board is a power coupler comprising an input microstrip divided into two output microstrips. Each output microstrip is connected to a separate excitation source. The input microstrip on the first printed circuit board and the input microstrip on the second printed circuit board are connected to separate outputs of a quadrature coupler. The input to the quadrature coupler is a feeder to a receiver or transmitter.

These and other advantages of the invention will be apparent to those of ordinary skill in the art by reference to the following detailed description and the accompanying drawings.

BRIEF DESCRIPTION OF THE DRAWINGS

FIG. 9C shows an aerial view of a printed circuit board configuration;

FIG. 9D-FIG. 9F show aerial views of different shapes of an exciter patch;

FIG. 10A-FIG. 10J show various views of printed circuit boards;

DETAILED DESCRIPTION

Figure 1A:
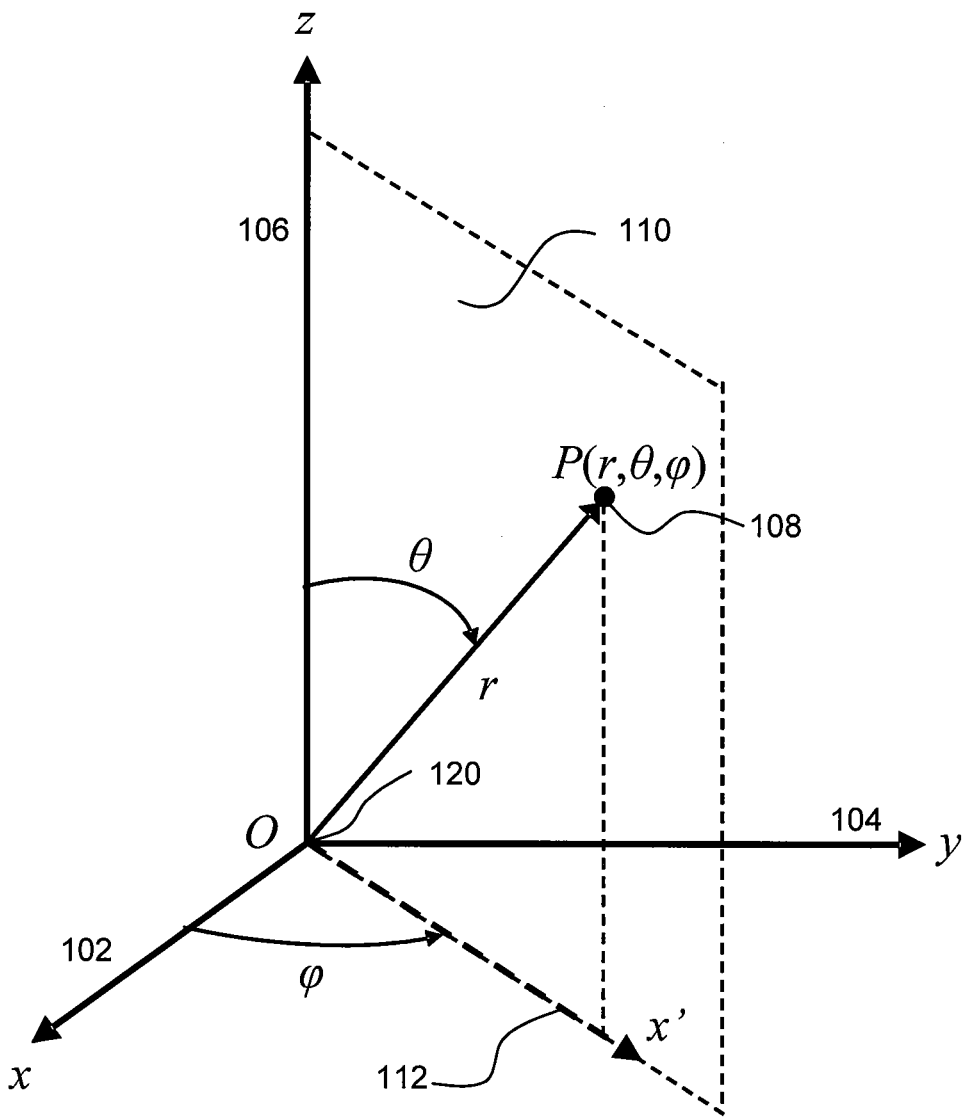
FIG. 1A-FIG. 1C show a reference coordinate system.
Figure 1B:
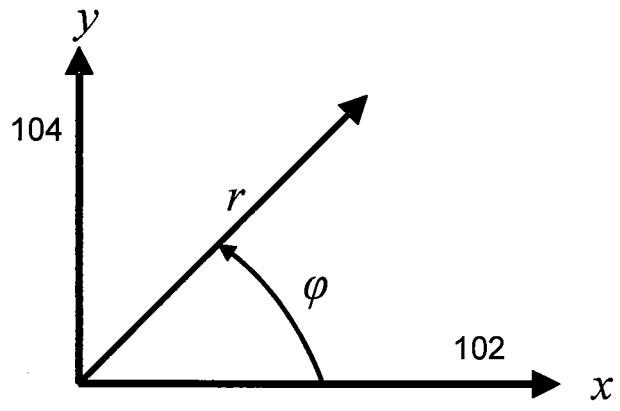
Figure 1C:
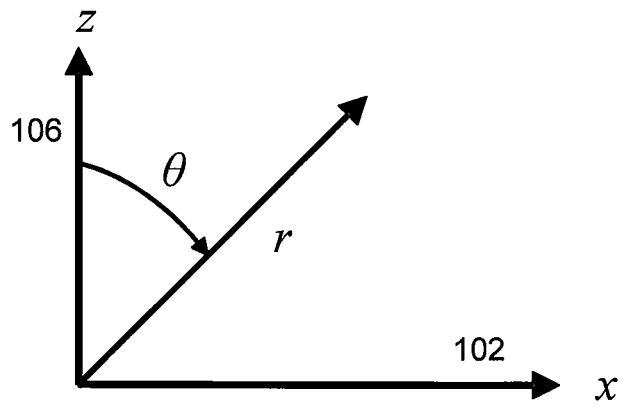

Embodiments of the invention are described with respect to a spherical coordinate system. Since there are multiple (some inconsistent) conventions for spherical coordinate systems, the convention used herein is illustrated in FIG. 1A-FIG. 1C. FIG. 1A shows a three-dimensional perspective view of a standard Cartesian coordinate system defined by the x-axis 102, y-axis 104, and z-axis 106. The spherical coordinates of a point P 108 are given by (r, θ, ϕ), where r is the radius measured from the origin O 120. The x-y plane is referred to as the azimuth plane; and ϕ, measured from the x-axis 102, is referred to as the azimuth angle. The plane defined by ϕ=constant and intersecting the z-axis 106 is referred to as a meridian plane. A general meridian plane 110, defined by the z-axis 106 and the x'-axis 112, is shown in FIG. 1A. The x-z plane and y-z plane are specific instances of meridian planes. The angle θ, measured from the z-axis 106, is referred to as the meridian angle.

FIG. 1B shows an orthogonal view of the azimuth plane defined by the x-axis 102 and the y-axis 104. FIG. 1C shows an orthogonal view of the meridian plane defined by the x-axis 102 and the z-axis 106. Unless otherwise stated, the symbol r is also used to represent a radius in a two-dimensional plot.

Note: In GPS applications, an antenna for a receiver is of interest. In the discussion below, following common practice in antenna design, analysis of characteristics of an antenna for a transmitter is described. From the well-known antenna reciprocity principle, the antenna characteristics in the receive mode correspond to the antenna characteristics in the transmit mode.

Figure 2A:
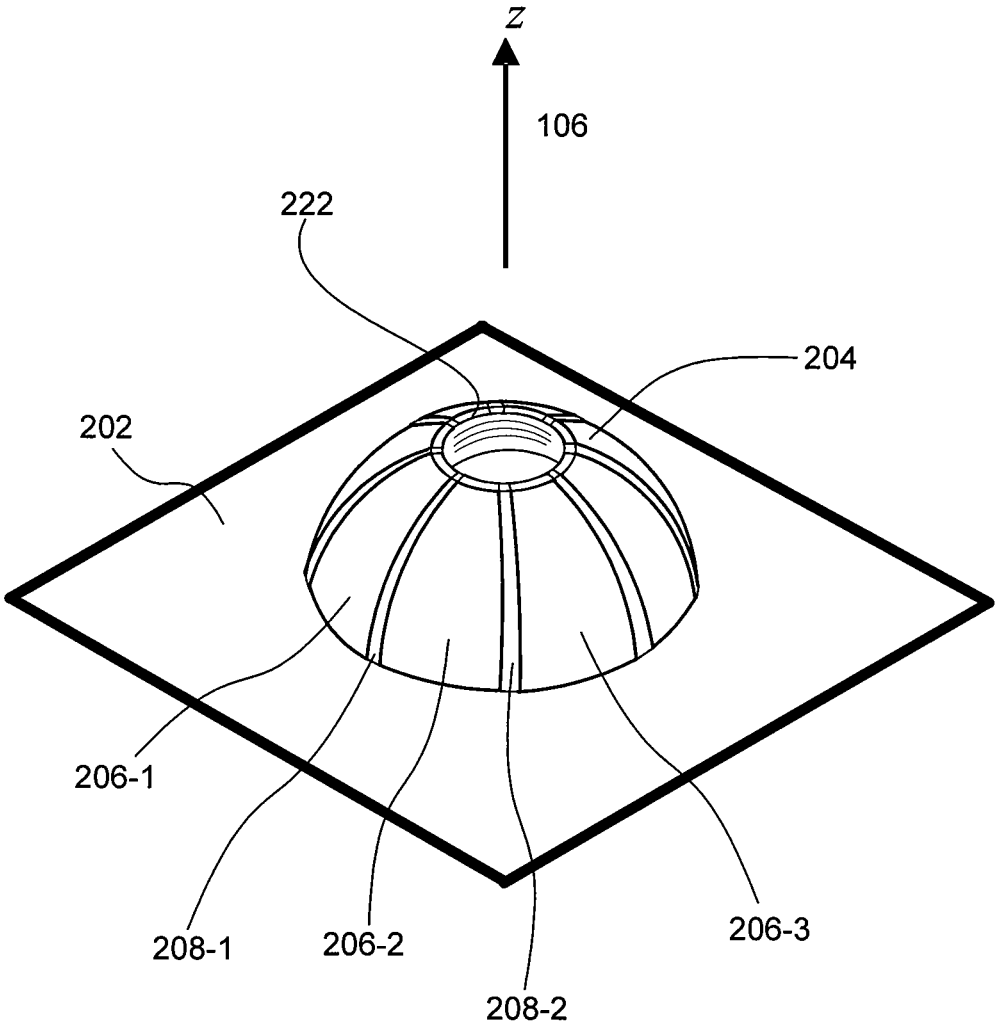
FIG. 2A-FIG. 2C show different views of hemispherical radiators.

An antenna according to an embodiment of the invention is shown in the perspective view of FIG. 2A. The antenna includes a circularly-polarized radiator 204 over a flat conducting ground plane 202. The dimensions are user-specified; dimensions for an embodiment are discussed below. The circularly-polarized radiator 204 has a convex shape, such as a hemisphere or semi-ellipsoid. In the embodiment shown in FIG. 2A, the circularly-polarized radiator 204 is a hollow hemispherical dome. The top of circularly-polarized radiator 204 is truncated with an aperture 222. The circularly-polarized radiator 204 comprises a set of N radiating conducting segments separated by a set of dielectric segments. In an embodiment of the invention, the conducting segments are fabricated from conducting sheets or films attached to a dielectric substrate (not shown in FIG. 2A, but see FIG. 2B below). Examples of conducting segments include pieces of metal foil glued to a dielectric substrate, metal films deposited onto a dielectric substrate, and metal films plated onto a dielectric substrate. Herein, a dielectric medium refers to either an air dielectric or a solid dielectric. A dielectric substrate refers to a solid dielectric.

The conducting segments are symmetrically distributed about an axis of symmetry orthogonal to the ground plane 202. Herein, this axis of symmetry is referred to as the antenna axis of symmetry. In the example shown, the antenna axis of symmetry coincides with the z-axis 106.

Figure 2B:
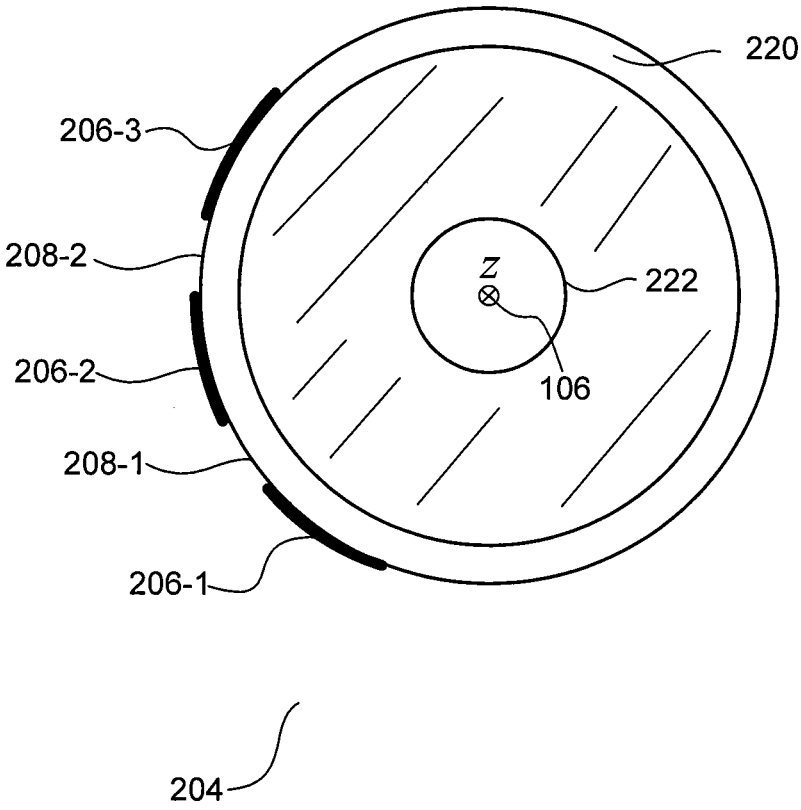

All N conducting segments operate in a similar mode. To simplify the discussion, shown in FIG. 2A are three representative conducting segments 206-1, 206-2, and 206-3 separated by dielectric segments 208-1 and 208-2. FIG. 2B is an orthogonal view of circularly-polarized radiator 204. The view shows the base (facing the ground plane 202) as viewed along the +z direction. Shown in this view are the dielectric substrate 220; aperture 222; conducting segments 206-1, 206-2, and 206-3; and dielectric segments 208-1 and 208-2 (portions of dielectric substrate 220). To simplify the figure, other conducting segments are not shown in FIG. 2B.

Figure 2C:
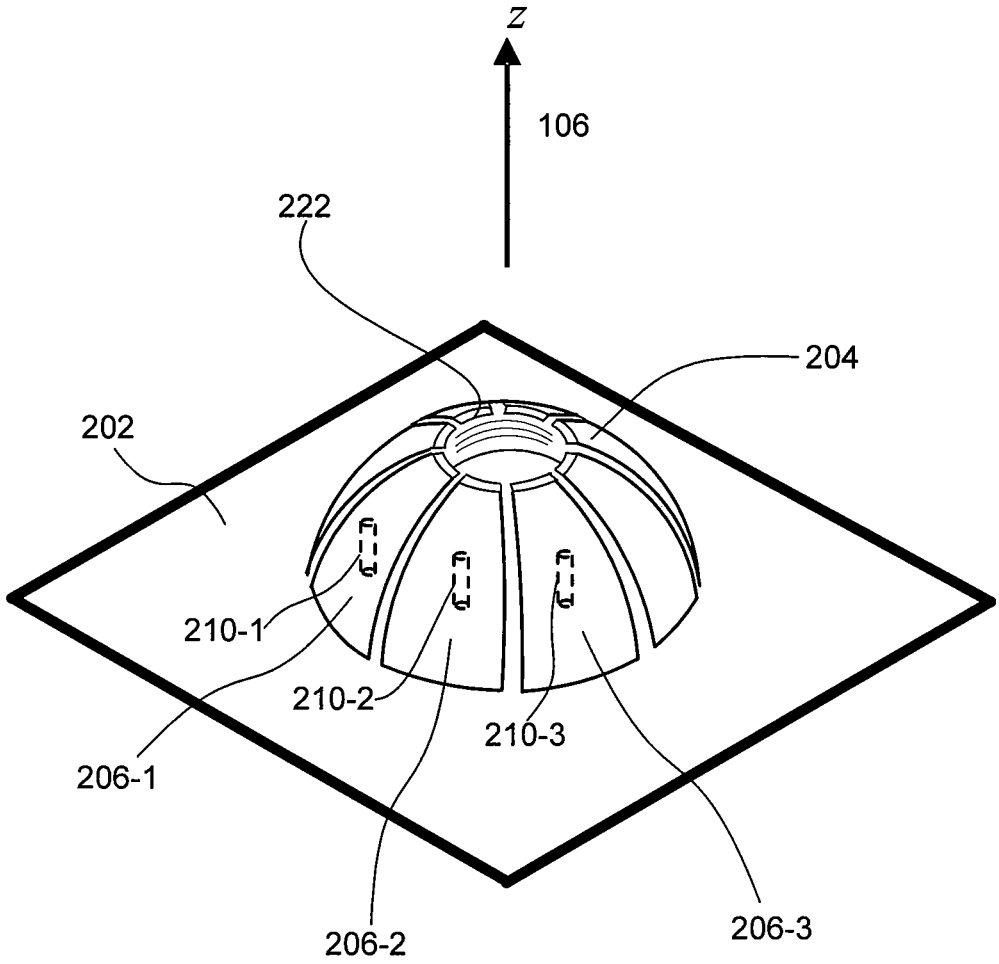

FIG. 2C shows an embodiment in which the conducting segments are supported by dielectric standoffs instead of a dielectric substrate. In this example, three representative conducting segments 206-1, 206-2, and 206-3 are fabricated from sheet metal. They are supported above ground plane 202 by dielectric standoffs 210-1, 210-2, and 210-3, respectively. An example of a dielectric standoff is a ceramic post. In this example, the individual conducting segments are separated by air gaps, instead of a dielectric substrate.

Figure 3A:
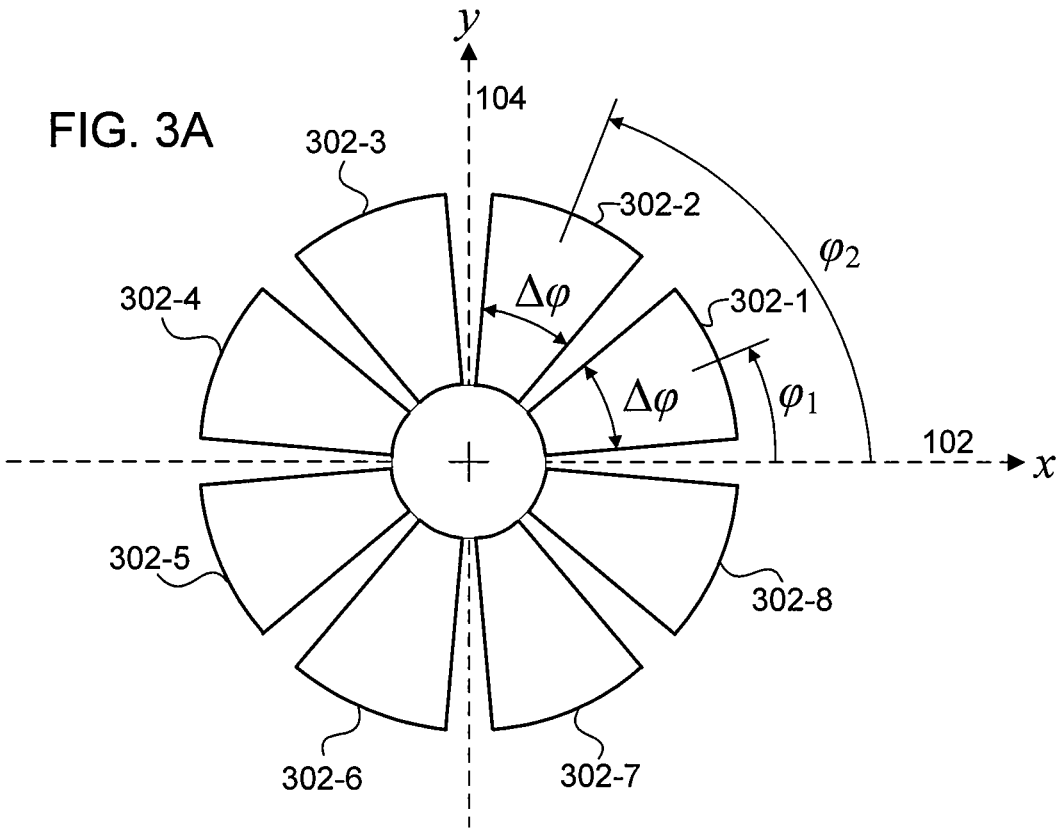
FIG. 3A and FIG. 3B show the reference geometry for a mathematical model of antenna characteristics.
Figure 3B:
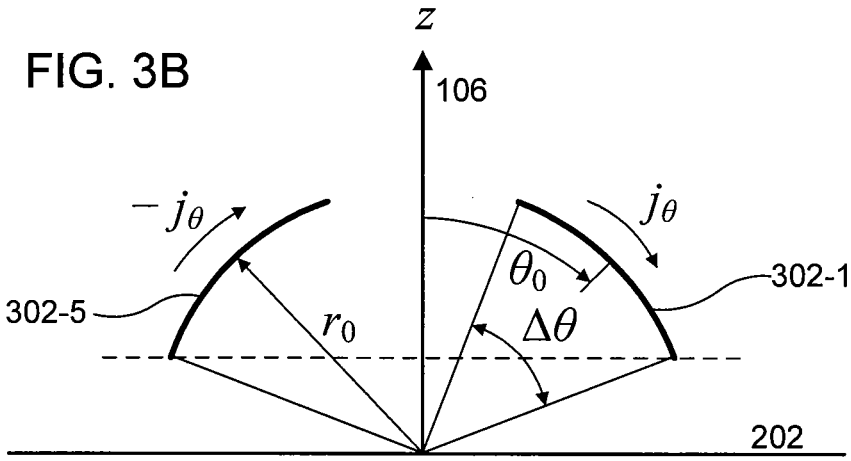

The frequency characteristics and antenna pattern of the circularly-polarized radiator 204 are a function of the geometric parameters of the convex surface, such as the shape of the radiating conducting segments and the number N of the radiating conducting segments. To estimate the operational parameters of the circularly-polarized antenna, a spherical model of the radiator (in which the convex surface is a hemisphere) is used. The reference geometry is shown in FIG. 3A and FIG. 3B. FIG. 3A shows a projection of the conducting segments onto the azimuth plane defined by the x-axis 102 and the y-axis 104. The x-y plane is parallel to the ground plane 202 in FIG. 2A. In this model, ground plane 202 is assumed to be of infinite size and to have ideal conductivity.

In this example, there are N=8 conducting segments, referenced as segments 302-1 to 302-8. In general, the index of a specific segment is denoted $\alpha$, where $\alpha=1, 2 \ldots N$ and N is the total number of segments. The azimuth angle of segment $\alpha$ is denoted $\phi_\alpha$, measured from the x-axis to the midpoint of the segment. In FIG. 3A, representative examples of azimuth angle are $\phi_1$ for segment 302-1 and $\phi_2$ for segment 302-2. The azimuth angular interval subtended by a segment is denoted $\Delta\phi$. As N increases (and consequently $\Delta\phi$ decreases), the electromagnetic field as a function of azimuth angle becomes more uniform.

FIG. 3B shows a cross-sectional view projected onto a meridian plane. In this example, the meridian plane slices through the midpoint of segment 302-1 and the midpoint of segment 302-5. The radius is denoted $r_0$. In the meridian plane, the meridian angle, measured from the z-axis 106 to the midpoint of a segment, is denoted $\theta_0$. The meridian angular interval subtended by the segment, also referred to as the sector angle, is denoted $\Delta\theta$.

Assuming that the spherical segments are sufficiently narrow, the $\theta$-component of the electric current, referred to as $j_\theta$, for each segment $\alpha$, is used for calculating the operational characteristics of the antenna. This model also assumes that the electric current distribution matches the lowest resonant oscillation. The volume density of the meridian current $\vec{j}_\alpha(r_0,\theta_0,\phi_\alpha)$ of segment $\alpha$ at the lowest resonant oscillation is expressed by:

$$\vec{j}_\alpha(r_0, \theta_0, \varphi_\alpha) = \vec{\theta}_0 \delta(r - r_0) \frac{I_\alpha}{r_0 \Delta\varphi} f(\theta, \theta_0), \tag{E1}$$

where:

$$f(\theta, \theta_0) = \frac{\cos\left[\frac{\pi}{\Delta\theta}(\theta - \theta_0)\right]}{\sin(\theta)}, \tag{E2}$$

$$\frac{\theta_0}{2} - \Delta\theta < \theta < \frac{\theta_0}{2} + \Delta\theta, \tag{E3}$$

$$\frac{\varphi_\alpha}{2} - \Delta\varphi < \varphi < \frac{\varphi_\alpha}{2} + \Delta\varphi, \text{ and} \tag{E4}$$

$\delta(x)$ is the Dirac delta function.

Since the antenna operates in a circularly-polarized mode, the current amplitude of each segment is:

$$I_\alpha = e^{-i(\alpha-1)\frac{2\pi}{N}}. \tag{E5}$$

Therefore, the currents at the opposite segment pairs (such as segment 302-1 and segment 302-5 in FIG. 3B) are shifted by $\pi$; that is, they are antiphase.

The problem of determining the current with the volume density given by (E1) may be solved by representing the Green's function in the form of the spherical harmonics expansion. [See, for example, L. Felsen, N. Marcuvitz, *Radiation and Scattering of Waves*, Vol. 2, 1973]. The full current resistance for the segment $\alpha$ is then given by:

$$Z_\alpha = \frac{-1}{|I_\alpha|^2}\int_V \vec{j}_\alpha^{\,*}\vec{E}\left(\sum_{\beta=1}^{N}\vec{j}_\beta\right)dV = \frac{\sum_n Z_0^n \sum_\beta I_\beta e^{in(\phi_\beta-\phi_\alpha)}}{I_\alpha}, \tag{E6}$$

where:

$$Z_0^n = -A\frac{W}{4\pi}\left[\frac{\sin\frac{n\Delta\phi}{2}}{\frac{n\Delta\phi}{2}}\right]^2\sum_\nu\{T1(\cdot)+T2(\cdot)\} \tag{E7}$$

$$T1(\cdot) = \frac{\partial}{\partial r}(rR_\nu^>(kr))_{r0}\frac{\partial}{\partial r}(rR_\nu^<(kr))_{r0}[I^E(\theta_0)+I^E(\pi-\theta_0)]I^E(\theta_0) \tag{E8}$$

$$T2(\cdot) = k^2n^2r_0^2R_\nu^>(kr)_{r0}R_\nu^<(kr)_{r0}[I^H(\theta_0)+I^H(\pi-\theta_0)]I^H(\theta_0) \tag{E9}$$

$$I^E(\theta_0) = \int_{\theta_0-\frac{\Delta\theta}{2}}^{\theta_0+\frac{\Delta\theta}{2}} f(\theta,\theta_0)\frac{\partial P_\nu^n(\cos\theta)}{\partial\theta}\sin(\theta)d\theta \tag{E10}$$

$$I^H(\theta_0) = \int_{\theta_0-\frac{\Delta\theta}{2}}^{\theta_0+\frac{\Delta\theta}{2}} f(\theta,\theta_0)P_\nu^n(\cos\theta)d\theta \tag{E11}$$

$$A = -\frac{2\nu+1}{\nu(\nu+1)}\frac{(\nu-n)!}{(\nu+n)!} \tag{E12}$$

$$R_\nu^>(r) = \sqrt{\frac{\pi}{2kr}}\,H_{\nu+\frac{1}{2}}^{(2)}(kr), \text{ and} \tag{E13}$$

$$R_\nu^<(r) = \sqrt{\frac{\pi}{2kr}}\,J_{\nu+\frac{1}{2}}(kr). \tag{E14}$$

Here $P_\nu^n(\cos\theta)$ is the associated Legendre function;

$$J_{\nu+\frac{1}{2}}(kr)$$

is the Bessel function; and $$H_{\nu+\frac{1}{2}}^{(2)}(kr)$$

is the second order Hankel function.

The expression for the antenna pattern (considering availability of image currents relative to the ground plane) is then:

$$F(\theta,\varphi) = \sum_n\sum_\beta I_\beta e^{in(\varphi_\beta-\varphi)}\sum_\nu A\frac{W}{4\pi}\frac{\sin\left(\frac{n\Delta\varphi}{2}\right)}{\frac{n\Delta\varphi}{2}}e^{i\frac{\pi}{2}\nu}\{T3(\cdot)+T4(\cdot)\} \tag{E15}$$

where:

$$T3(\cdot) = \left[\frac{\partial}{\partial r}(rR_\nu^<(kr)\right]_{r0}[I_1(\theta_0)+I_1(\pi-\theta_0)]\frac{\partial P_\nu^n(\cos\theta)}{\partial\theta}, \text{ and} \tag{E16}$$

$$T4(\cdot) = \frac{ki}{n^2}r_0R_\nu^<(kr_0)[I_2(\theta_0)+I_2(\pi-\theta_0)]\frac{P_\nu^n(\cos(\theta)}{\sin(\theta)}. \tag{E17}$$

Figure 4:
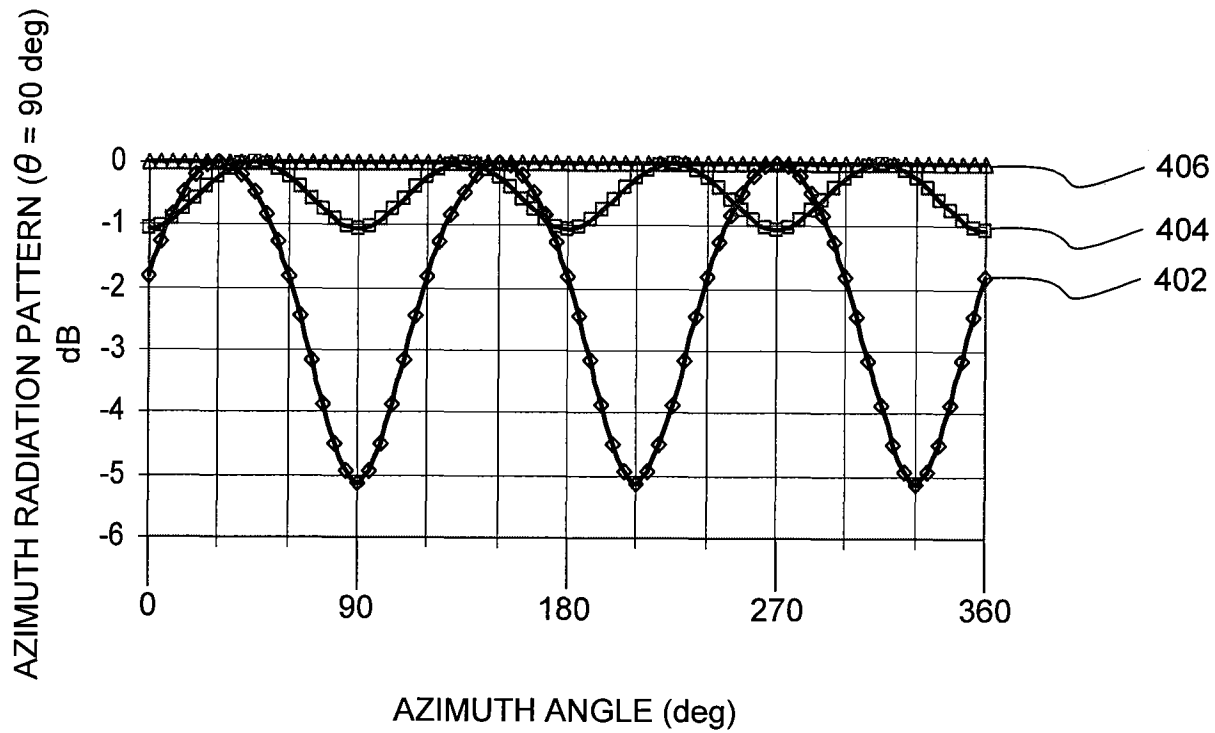
FIG. 4 shows plots of azimuth radiation patterns as a function of azimuth angle for different values of number of segments.

Calculated results for (E6) and (E15) are shown in FIG. 4-FIG. 7. FIG. 4 shows plots of azimuth radiation patterns in the equatorial plane (θ=90°) for different values of the number of segments N. The vertical axis represents the azimuth radiation pattern in dB. The horizontal axis represents the azimuth angle in deg. Plot 402 represents the results for N=3; plot 404 represents the results for N=4; and plot 406 represents the results for N=8. As N increases, the amplitude of azimuth oscillations decreases. For N=8, the amplitude of the azimuth oscillations is nearly zero.

Figure 5:
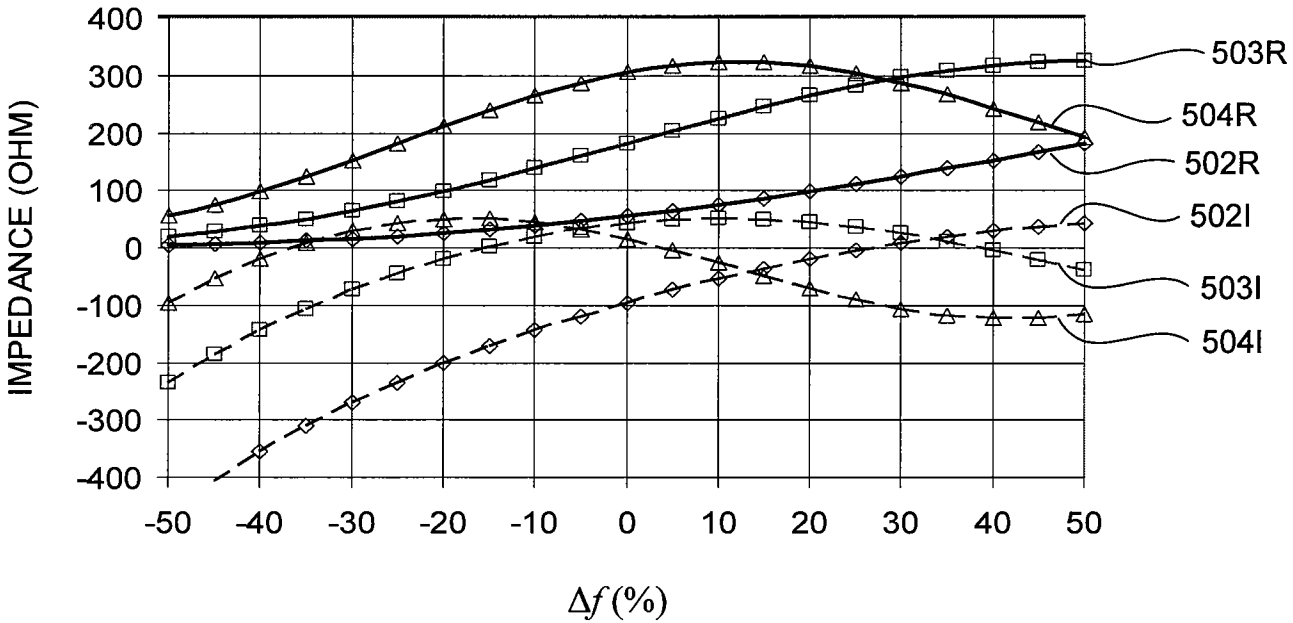
FIG. 5 shows plots of impedance as a function of bandwidth for different values of radius.
Figure 6:
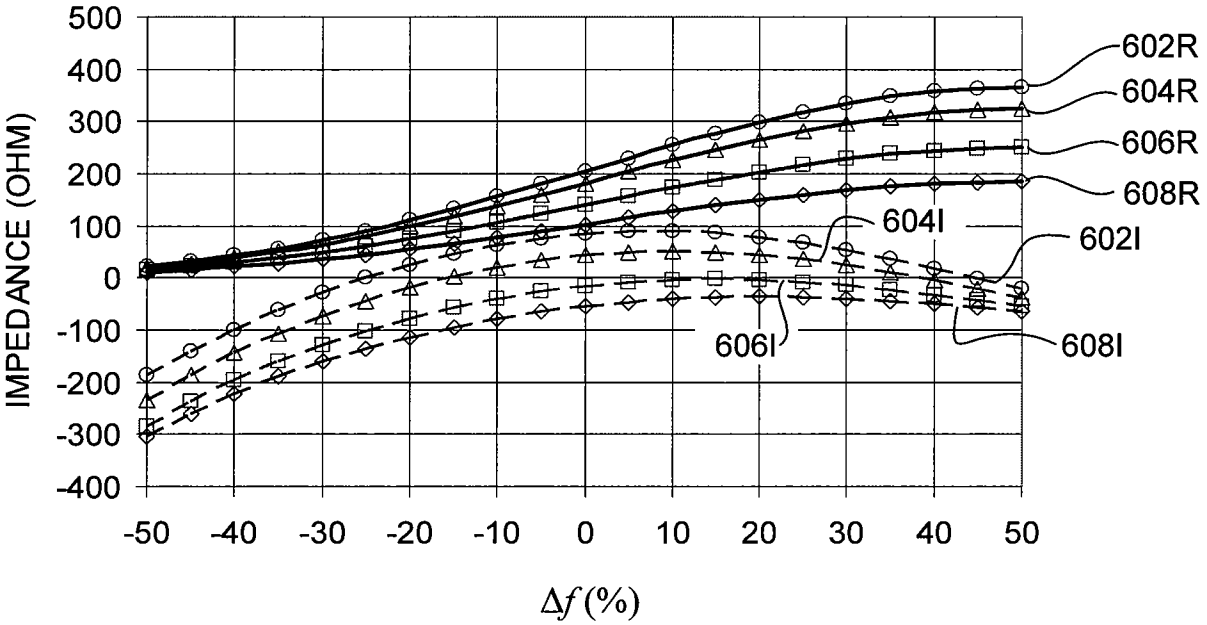
FIG. 6 shows plots of impedance as a function of bandwidth for different values of angular interval.
Figure 7:
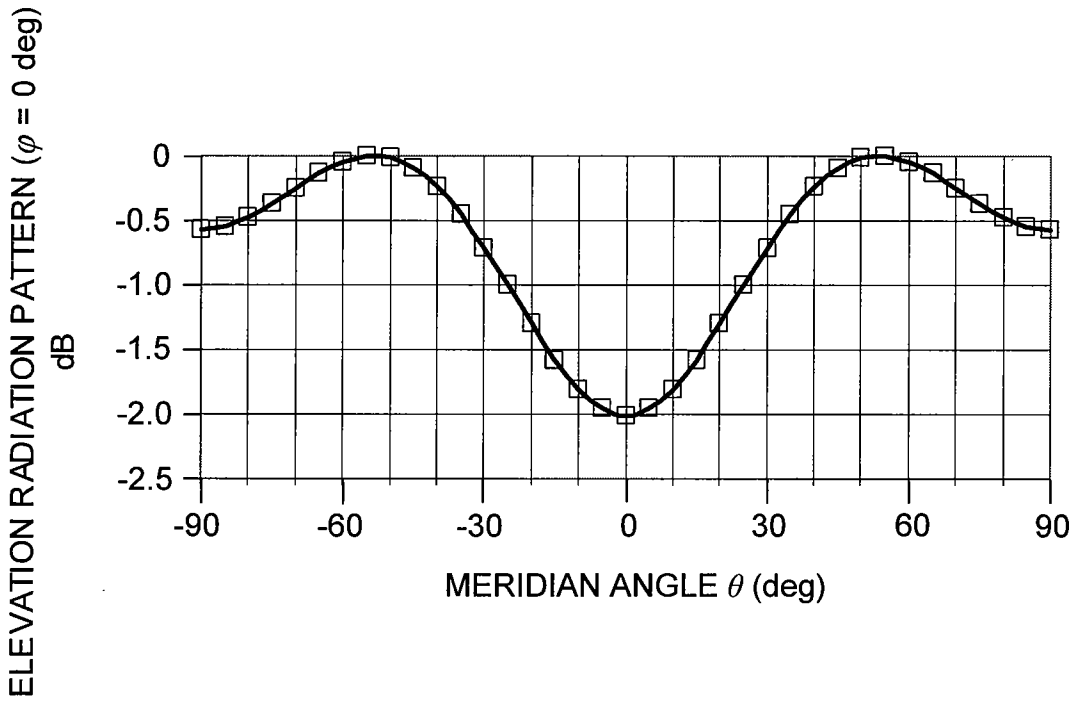
FIG. 7 shows a plot of elevation radiation pattern as a function of meridian angle.

FIG. 5-FIG. 7 show operational characteristics for N=8. FIG. 5 and FIG. 6 show frequency characteristics of sector impedance (the impedance of one sector considering the effects of the whole set of segments). The vertical axis represents the impedance in ohms. The horizontal axis represents the frequency deviation Δf from the central frequency of the band (in percent). Frequency characteristics are estimated by setting the reactive component of input resistance to zero. FIG. 5 shows plots for different values of radius $r_0$. The angular interval Δθ of the segment is held fixed at 80 deg. Plot 502R and plot 502I represent the real (Re) and imaginary (Im) parts, respectively, of the complex impedance for $r_0$=0.2λ, where λ is the signal wavelength corresponding to the center frequency; plot 503R and plot 503I represent the real and imaginary parts, respectively, of the complex impedance for $r_0$=0.3λ; and plot 504R and plot 504I represent the real and imaginary parts, respectively, of the complex impedance for $r_0$=0.4λ. At a radius of approximately $r_0$=0.3λ, the curve Im(Z) (plot 503I) becomes convex. In this case, the reactive component of the impedance differs slightly from zero within a total frequency range of about 50% (−25% to +25%). This result confirms bandwidth expansion. As the radius $r_0$ is reduced, the resonance becomes narrow-band and is shifted to a high-frequency range. Herein, signal wavelength refers to the wavelength of electromagnetic radiation that the antenna is designed to receive or transmit.

FIG. 6 shows plots for different angular intervals Δθ at a fixed radius of $r_0$=0.3λ. Plot 602R and plot 602I represent the real and imaginary parts, respectively, of the complex impedance for Δθ=85°; plot 604R and plot 604I represent the real and imaginary parts, respectively, of the complex impedance for Δθ=80°; plot 606R and plot 606I represent the real and imaginary parts, respectively, of the complex impedance for Δθ=70°; and plot 608R and plot 608I represent the real and imaginary parts, respectively, of the complex impedance for Δθ=60°. At small values of the angular interval Δθ, the reactive component of the impedance reveals a capacitive pattern. As Δθ increases, however, the reactive component decreases and transitions to the inductive range. At Δθ equal to about 80°, the reactive component is small within the widest frequency band. If Δθ keeps increasing (that is, by reducing the gap between the conductive surface of the segment and the ground plane), the reactive impedance component becomes almost completely inductive. Consequently, impedance matching of the radiator with the feeder is inhibited. The feeder (conductor which feeds the radiator) is discussed in more detail below.

FIG. 7 shows an antenna pattern in the meridian plane. The vertical axis represents the elevation antenna pattern in dB. The horizontal axis represents the meridian angle θ in deg. The radius is fixed at $r_0$=0.3λ; the azimuth angle is fixed at φ=0°; and the sector angle is fixed at Δθ=80 deg. The antenna pattern exhibits a weakly directional table-like pattern in the entire front hemisphere (that is, the directional pattern in the front hemisphere is nearly uniform). It provides good signal reception for navigation and communications satellites close to the horizon (where the horizon corresponds to a value of θ near 90 deg).

For a radius $r_0$=0.3λ, calculations show that radiator operation with a bandwidth of 50% is possible. Here, the bandwidth is specified by the condition that the reactive component of the input resistance is close to zero (approximately 0.2 times the active component was used for an estimate). To achieve this, the sector angle is approximately $\Delta\theta=80$ deg. Note that a number of assumptions has been taken in the modelling: single-mode approximation for the current density of segments was used; the azimuth component was neglected; and no impact of the exciter design (discussed below) was considered. Therefore, the above dimensions are considered to be initial approximations. More precise values (discussed below) have been determined by experimental measurements; in particular, over the frequency range of 1150-1730 MHz.

Figure 9A:
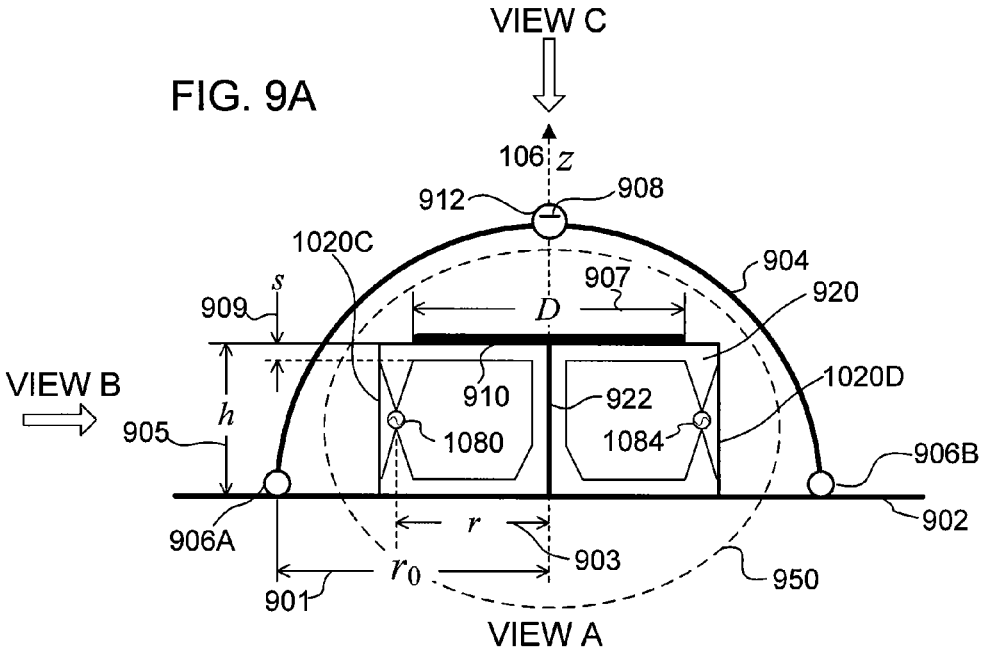
FIG. 9A and FIG. 9B show cross-sectional views of an embodiment of a circularly-polarized antenna.
Figure 9B:
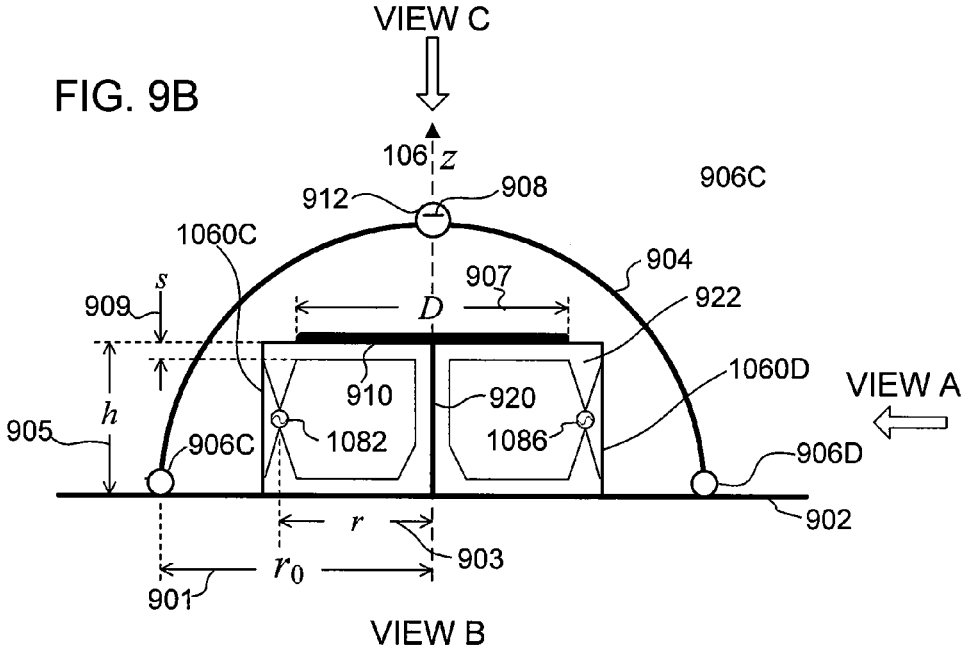

FIG. 9A (View A) and FIG. 9B (View B) show orthogonal cross-sectional views of a circularly-polarized antenna according to an embodiment of the invention. A hemispherical dome radiator 904 containing convex conducting segments (as shown in FIG. 2A, for example) is supported over ground plane 902 by dielectric spacers 906A-906D, which create a gap between radiator 904 and ground plane 902. The radiator 904 is excited by an excitation system 950 located within the radiator 904 and above ground plane 902. Excitation system 950 comprises exciter patch 910 and a pair of orthogonal printed circuit boards (PCBs), denoted PCB 920 and PCB 922. In an embodiment of the invention, exciter patch 910 is a non-resonant conducting flat plate. It is aligned parallel to ground plane 902 and mounted above PCB 920 and PCB 922.

FIG. 9C (View C) shows an aerial view (viewed along the −z axis) of PCB 920 and PCB 922. References for the sides (1032, 1034) and edges (1020C, 1020D) of PCB 920 and for the sides (1042, 1044) and edges (1060C, 1060D) are discussed further below. FIG. 9D-FIG. 9F show aerial views of various geometric embodiments of exciter patch 910. In FIG. 9D, exciter patch 910A has the shape of a circle with diameter D. In FIG. 9E, exciter patch 910B has the shape of a square with side length D. In FIG. 9F, exciter patch 910C has the shape of a regular hexagon with diameter (diagonal) D. In general, the shape of exciter patch 910 is user-specified. For example, it may be a circle, a square, or a regular polygon with M-sides, where M is an integer greater than or equal to three. The dimension D is referred to herein as a characteristic linear dimension of exciter patch 910.

FIG. 10A and FIG. 10B show cross-sectional views of PCB 920 and PCB 922, respectively. PCB 920 is formed from a dielectric substrate 1030 with metallization on both sides, side A 1032 and side B 1034. Similarly, PCB 922 is formed from a dielectric substrate 1040 with metallization on both sides, side A 1042 and side B 1044. The structure of the metallized elements on PCB 920 and PCB 922 are similar, as discussed below. In some embodiments, separate conductors such as wires may be used in addition to or in place of metallization.

FIG. 10C shows side A 1032 of PCB 920, which has a rectangular shape with long edge 1020A, long edge 1020B, short edge 1020C, and short edge 1020D. The axis of symmetry perpendicular to long edge 1020B and intersecting the center of long edge 1020B is referred to herein as a board axis of symmetry. In the example shown, the board axis of symmetry is coincident with the z-axis 106. Slot 1006, cut out from PCB 920, is used for mounting (see below). Herein, a rectangular shape includes a square shape; that is the length of all four edges are the same in some embodiments.

Area 1021 (drawn with hatch lines) is metallized (conducting area). The non-metallized areas are regions of the dielectric substrate 1030. Metallized area 1021 includes strip 1001A along long edge 1020A and strip 1001B and conducting strip 1001C along long edge 1020B. Strip 1001B and strip 1001C are separated by slot 1006. The width of a strip, referenced as width s 909 (see also FIG. 9A and FIG. 9B), is user-defined. Strip 1001A, strip 1001B, and strip 1001C are joined by bridge 1002. Along short edge 1020C are triangular area 1003A and triangular area 1003B, which are separated by gap 1004A. Along short edge 1020D are triangular area 1003C and triangular area 1003D, which are separated by gap 1004B.

Figure 10D:
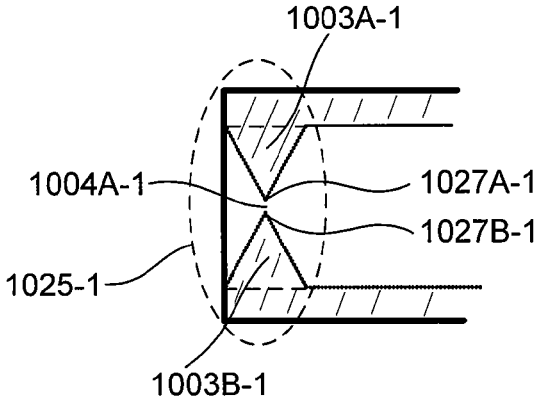
Figure 10E:
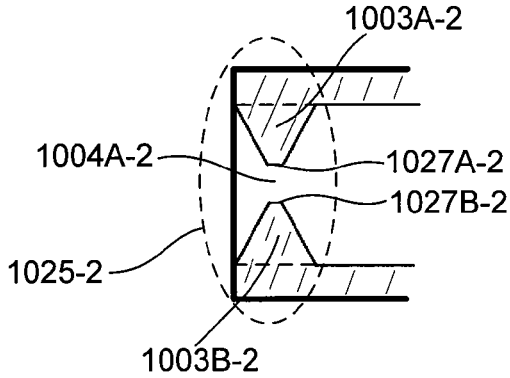

Two embodiments of the geometrical features in region 1025 (FIG. 10C) are shown in FIG. 10D (region 1025-1) and FIG. 10E (region 1025-2). In FIG. 10D, area 1003A-1 is a triangle with apex 1027A-1, and area 1003B-1 is a triangle with apex 1027B-1. Gap 1004A-1 is the space between apex 1027A-1 and apex 1027B-1. In FIG. 10E, area 1003A-2 is an isoceles trapezoid with top 1027A-2, and area 1003B-2 is an isoceles trapezoid with top 1027B-2. Gap 1004A-2 is the space between top 1027A-2 and top 1027B-2. In an embodiment, the width of the wide base of the trapezoid is equal to the width of the strip s 909. Depending on user-specified design criteria, the width of the wide base of the trapezoid may also be less than or greater than the width of the strip s 909. Similarly, triangular area 1003C and triangular area 1003D may be replaced with trapezoidal areas.

In other embodiments, region 1003A and region 1003B may have other user-specified shapes. In general, region 1003A has a wide base along the direction of edge 1020A and tapers to a tip along the direction of edge 1020C towards edge 1020B. The tip may have a sharp point (as shown in FIG. 10D), a flat end (as shown in FIG. 10E), or some other user-defined shape (such as a curved end). Similarly, in general, region 1003B has a wide base along the direction of edge 1020B and tapers to a tip along the direction of edge 1020C towards edge 1020A. Herein, region 1003A and region 1003B are referred to as electrodes. Conducting strip 1001A terminates in electrode 1003A near edge 1020C, and conducting strip 1001B terminates in electrode 1003B near edge 1020C. Similarly, conducting strip 1001A terminates in electrode 1003C near edge 1020D, and conducting strip 1001C terminates in electrode 1003D near edge 1020D.

Figure 10F:
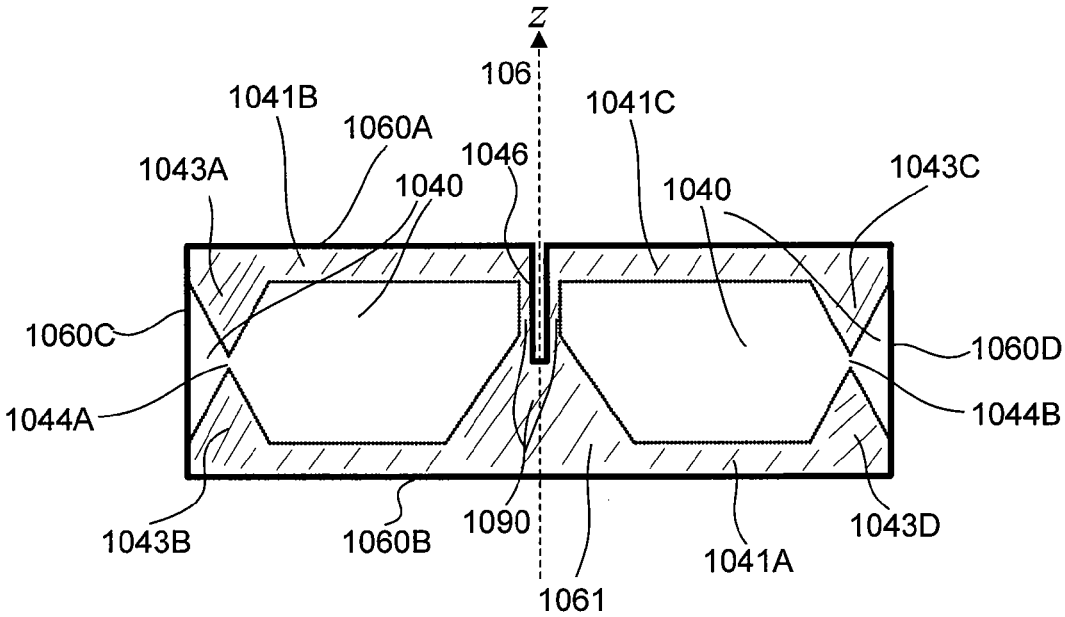

Similarly, FIG. 10F shows side A 1042 of PCB 922, which has a rectangular shape with long edge 1060A, long edge 1060B, short edge 1060C, and short edge 1060D. Slot 1046, cut out from PCB 922, is used for mounting (see below). Area 1061 (drawn with hatch lines) is metallized (conducting area). The non-metallized areas are regions of the dielectric substrate 1040. Metallized area 1061 includes strip 1041A along long edge 1060B and strip 1041B and strip 1041C along long edge 1060A. Strip 1041B and strip 1041C are separated by slot 1046. Strip 1041A, strip 1041B, and strip 1041C are joined by bridge 1090. Along short edge 1060C are triangular area 1043A and triangular area 1043B. The apex of triangular area 1043A and the apex of triangular area 1043B are separated by gap 1044A. Along short edge 1060D are triangular area 1043C and triangular area 1043D. The apex of triangular area 1043C and the apex of triangular area 1043D are separated by gap 1044B. As in PCB 920, triangular area 1043A—triangular area 1043D may also be replaced with trapezoidal areas (as shown in FIG. 10E) or other electrodes.

Figure 10G:
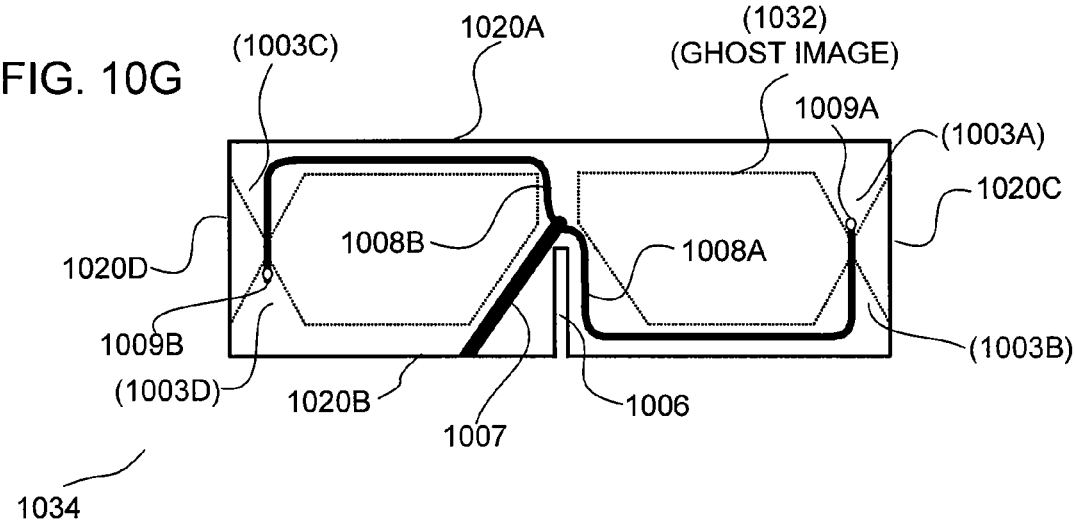

FIG. 10G shows side B 1034 of PCB 920. Conductor 1007 splits into two legs, conductor 1008A and conductor 1008B, near the center of side B 1034 to form a microstrip line. The geometric shape of conductor 1007, conductor 1008A, and conductor 1008B are user-defined. The metallized area 1021 on side A 1032 serves as the ground plane for the microstrip line. Metallized hole 1009A and metallized hole 1009B (which pass through dielectric substrate 1030) are used for electrical connections from side B 1034 to side A 1032 (discussed below). Geometric features on side A 1032 (FIG. 10C)

are shown as a dotted-line ghost image in FIG. 10G. Reference numbers on the ghost image are placed in ( ) such as (1032).

Figure 10H:
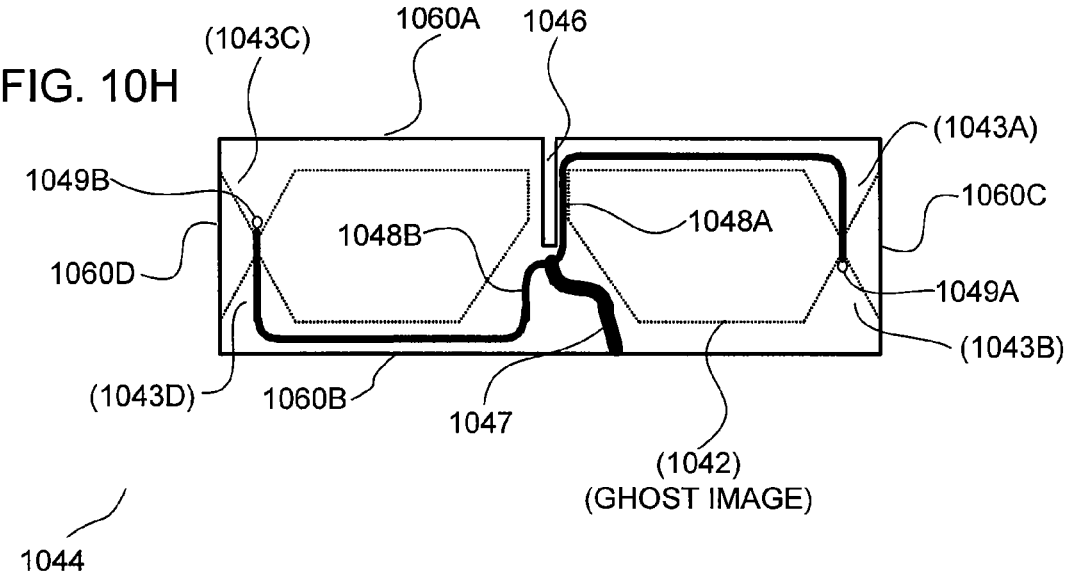

Similarly, FIG. 10H shows side B 1044 of PCB 922. Conductor 1047 splits into two legs, conductor 1048A and conductor 1048B, near the center of side B 1044 to form a microstrip line. The geometric shape of conductor 1047, conductor 1048A, and conductor 1048B are user-defined. The metallized area 1061 on side A 1042 serves as the ground plane for the microstrip line. Metallized hole 1049A and metallized hole 1049B (which pass through dielectric substrate 1040) are used for electrical connections from side B 1044 to side A 1042 (discussed below). Geometric features on side A 1042 (FIG. 10F) are shown as a dotted-line ghost image in FIG. 10H. Reference numbers on the ghost image are placed in ( ) such as (1042).

As shown in FIG. 10C and FIG. 10F, PCB 920 has a slot 1006, and PCB 922 has a slot 1046. In an embodiment of the invention, PCB 920 and PCB 922 are mated together. PCB 920 is oriented orthogonal to PCB 922, and slot 1006 is inserted into slot 1046. An orthogonal view of the PCB assembly (viewed along the −z direction, is shown in FIG. 9C.

In PCB 920, the ground plane for the microstrip line (metallized area 1021 in FIG. 10C) is connected to ground plane 902 and exciter patch 910 (see FIG. 9A and FIG. 9B) by soldering. Microstrip line 1007, microstrip line 1008A, and microstrip line 1008B form an equal-amplitude power coupler providing antiphase field excitation in gap 1004A and gap 1004B (see FIG. 10C and FIG. 10G). The power coupler is configured according to a scheme in which microstrip line 1007, with wave resistance W, is divided into two microstrip lines, microstrip line 1008A and microstrip line 1008B. The wave resistance of each of microstrip line 1008A and microstrip line 1008B is 2W. The wave resistance of each of gap 1004A and gap 1004B is 2W. The wave resistance W is typically specified as 50 ohm; however, other values may be used. The length of microstrip line 1008A and the length of microstrip line 1008B are the same.

Antiphase excitation is attained by routing the microstrip line 1008B with wave resistance 2W over triangular area 1003C of metallized area 1021 and terminating it at triangular area 1003D by soldering through metallized hole 1009B. Similarly, microstrip line 1008A is routed over triangular region 1003B and terminated at triangular area 1003A by soldering through metallized hole 1009A.

PCB 922 is similarly configured. The microstrip shield (metallized area 1061 in FIG. 10F) is connected to ground plane 902 and exciter patch 910 (see FIG. 9A and FIG. 9B) by soldering. Microstrip line 1047, microstrip line 1048A, and microstrip line 1048B form an equal-amplitude power coupler providing antiphase field excitation in gap 1044A and gap 1044B (see FIG. 10F and FIG. 10H). The power coupler is configured according to the scheme in which microstrip line 1047, with wave resistance W, is divided into two microstrip lines, microstrip line 1048A and microstrip line 1048B. The wave resistance of each of microstrip line 1048A and microstrip line 1048B is 2W. The wave resistance of each of gap 1044A and gap 1044B is 2W. The wave resistance W is typically specified as 50 ohm; however, other values may be used. The length of microstrip line 1048A and the length of microstrip line 1048B are the same.

Antiphase excitation is attained by routing the microstrip line 1048B with wave resistance 2W over triangular area 1043D of metallized area 1061 and terminating it at triangular area 1043C by soldering through metallized hole 1049B. Similarly, microstrip line 1048A is routed over triangular region 1043A and terminated at triangular area 1043B by soldering through metallized hole 1049A.

Figure 10I:
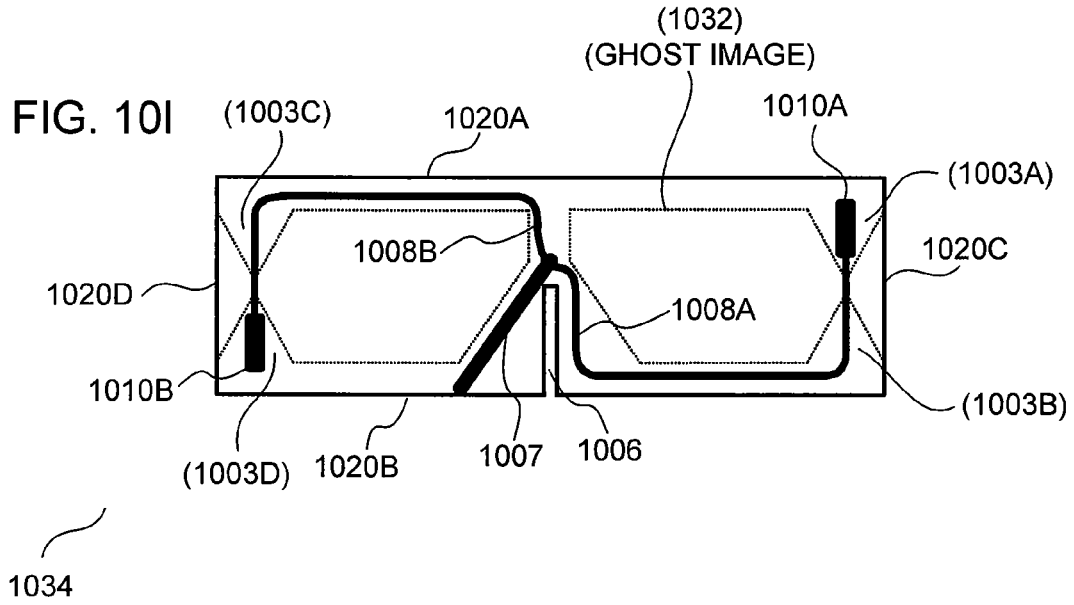
Figure 10J:
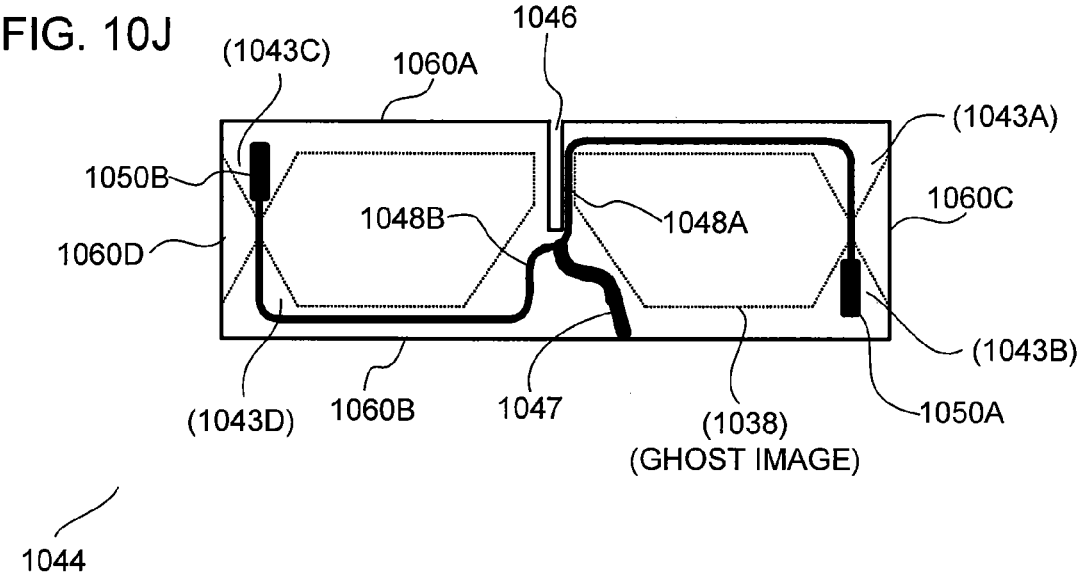

FIG. 10I and FIG. 10J show another embodiment, in which the microstrip lines are capacitively coupled to the ground planes of the microstrips, instead of being shorted to the ground planes of the microstrips. FIG. 10I shows side B 1034 of PCB 920. Microstrip line 1008A terminates in pad 1010A, which capacitively couples with triangular region 1003A. Similarly, microstrip line 1008B terminates in pad 1010B, which capacitively couples with triangular area 1003D. FIG. 10J shows side B 1044 of PCB 922. Microstrip line 1048A terminates in pad 1050A, which capacitively couples with triangular region 1043B. Similarly, microstrip line 1048B terminates in pad 1050B, which capacitively couples with triangular area 1043C.

Herein, a pair of electrodes whose tips are separated by a gap forms an embodiment of an excitation source. When electromagnetic energy is fed to the electrodes (as described below), an excitation field is generated at the gap. For example, referring to FIG. 10D, electrode 1003A-1 and electrode 1003B-1 form an excitation source which generates an excitation field at gap 1004A-1. As represented schematically in FIG. 9A, FIG. 9B, and FIG. 10K, excitation system 950 includes four excitation sources, denoted excitation source 1080—excitation source 1086.

Figure 16:
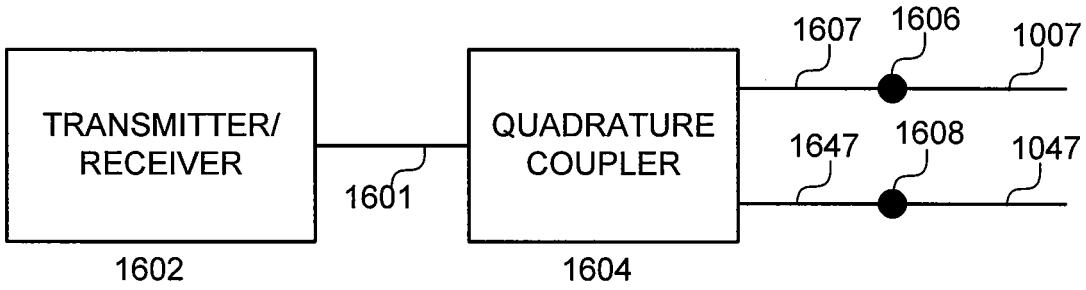
FIG. 16 shows a high-level schematic of an antenna system.

FIG. 16 shows a high-level schematic of an antenna system, according to an embodiment of the invention. The output of transmitter/receiver 1602 is connected via feeder 1601 to the input of quadrature (90° coupler 1604. The outputs (which are phase shifted by 90° from one another) of quadrature coupler 1604 are connected to output microstrip lines with wave resistance W. Output microstrip line 1607 is coupled with microstrip line 1007 on PCB 920 (see FIG. 10G) at connection 1606. Similarly, output microstrip line 1647 is coupled with microstrip line 1047 on PCB 922 (see FIG. 10H) at connection 1608. In one embodiment, connection 1606 and connection 1608 are solder joints (as represented in FIG. 11 below).

Figure 10K:
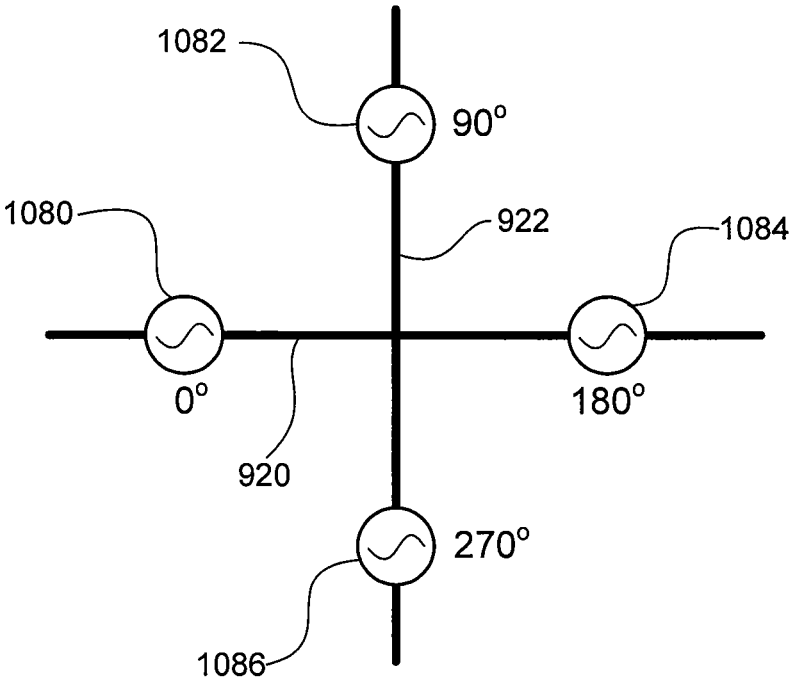
FIG. 10K shows a schematic of excitation sources.

The 90° phase shift between PCB 920 and PCB 922 yields right circular polarization, as illustrated in FIG. 10K. Excitation source 1080 on PCB 920 is used as the reference phase (0°. Excitation source 1082 on PCB 922 is shifted by 90° via quadrature coupler 1604. Excitation source 1084 on PCB 920 is shifted by 180° because it operates in antiphase mode to excitation source 1080 (as described above). Similarly, excitation source 1086 on PCB 922 is shifted by 270° because it operates in antiphase mode to excitation source 1082 on PCB 922. The combination of the power dividing and phase shift schemes described above results in excitation source 1080, excitation source 1082, excitation source 1084, and excitation source 1086 generating equal-amplitude fields with successive phase shifts of 90°, thereby providing circularly-polarized mode of operation. The antiphase mode (180° phase shift) between excitation source 1080 and excitation source 1084 on PCB 920 is independent of frequency. Similarly, the antiphase mode between excitation source 1082 and excitation source 1086 on PCB 922 is independent of frequency. Consequently, excitation system 950 operates over a wide frequency range.

Figure 11:
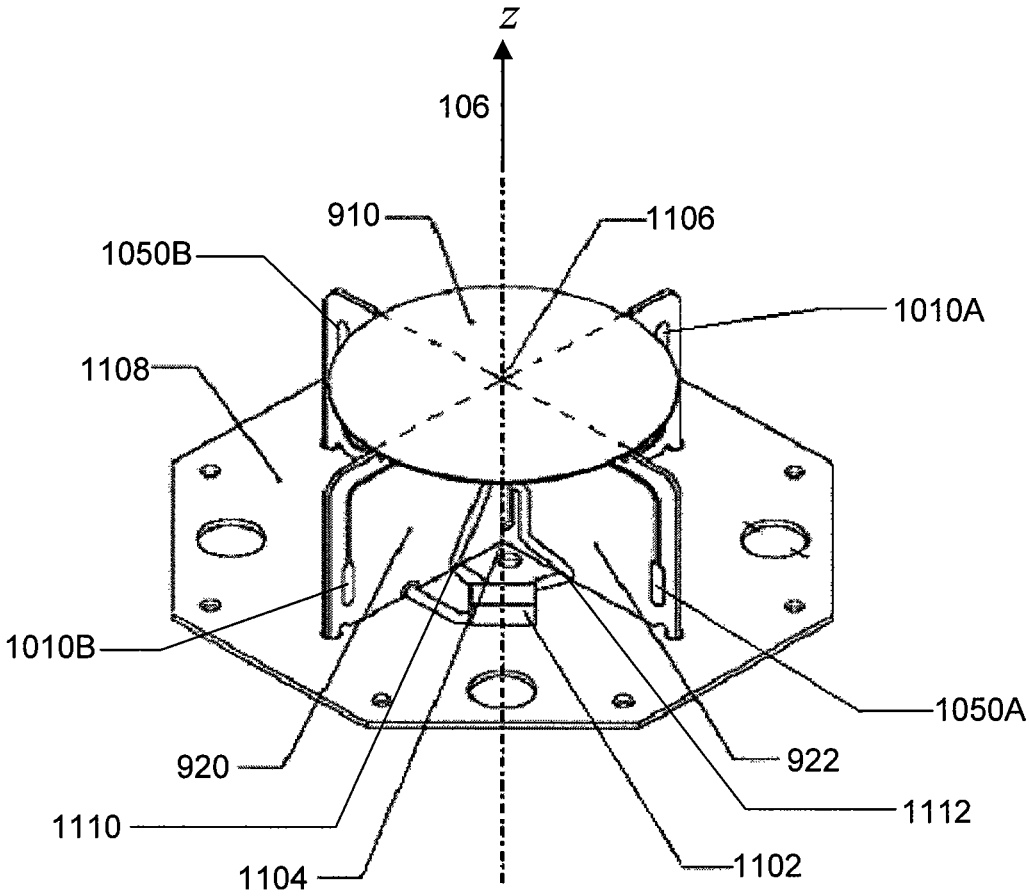
FIG. 11 shows a perspective view of an embodiment of an excitation system.

FIG. 11 shows a perspective view of an excitation system 950, according to an embodiment of the invention. PCB 920 and PCB 922 are mated at right angles to form a cross-shaped structure by inserting slot 1006 of PCB 920 into slot 1046 of PCB 922 (see FIG. 10C and FIG. 10F). The line of intersection of PCB 920 and PCB 922 (between reference point 1104 and reference point 1106) falls along (is coincident with) the vertical axis of symmetry (z-axis 106) of the antenna. In this example, the capacitively coupled pads shown in FIG. 10I and FIG. 10J are used. Exciter patch 910 is above the cross-shaped structure opposite to ground plane 902. In this embodiment, the quadrature coupler 1102 is fabricated as a microchip and mounted on a separate printed circuit board PCB 1108, which is installed on ground plane 902. Metal foil on one side of PCB 1108 serves as a ground plane of a specified size. Solder joint 1110 and solder joint 1112 (corresponding to connection 1606 and connection 1608 in FIG. 16) connect outputs of the quadrature coupler 1102 to the input of PCB 920 and input of PCB 922, respectively.

In the embodiments of excitation system 950 described above, the excitation sources are formed by metallized structures on printed circuit boards. One skilled in the art may develop other embodiments of an excitation system. For example, in some embodiments, coaxial cables are used instead of microstrip lines. As previously described in FIG. 10K, embodiments of an excitation system comprise four excitation sources symmetrically arranged about an axis of symmetry (herein referred to as a system axis of symmetry). The excitation sources generate equal-amplitude fields with successive phase shifts of 90 deg.

In an embodiment, to generate an antenna pattern that is uniform as a function of azimuth angle, the number of conducting segments on radiator 904 (see FIG. 9A and FIG. 9B) is set as a multiple of 4; however, other values of N (for example, ranging from 3 to 16) may be used. There is electromagnetic coupling between the conducting segments on radiator 904 and the excitation system 950. Reducing the spacing between the conducting segments on radiator 904 and the excitation system 950 reduces the resonant size of the radiator 904. Capacitive coupling of each conducting segment on radiator 904 with ground plane 902 also has a strong influence on the frequency characteristics of the antenna. Capacitive coupling is a function of the separation (gap) between the radiator 904 and ground plane 902. In FIG. 9A and FIG. 9B, this separation is a function of the height of dielectric spacers 906A-906D. Capacitive coupling is further controlled with auxiliary radiator 908, which is separated by a gap from radiator 904. In an embodiment, the separation of auxiliary radiator 908 from radiator 904 is configured by dielectric spacer 912 (the gap may be an air gap, or the gap may be filled with a solid dielectric). The separation between radiator 904 and ground plane 902 and the separation between auxiliary radiator 908 and radiator 904 allows a reduction in $r_0$ 901.

Figure 8:
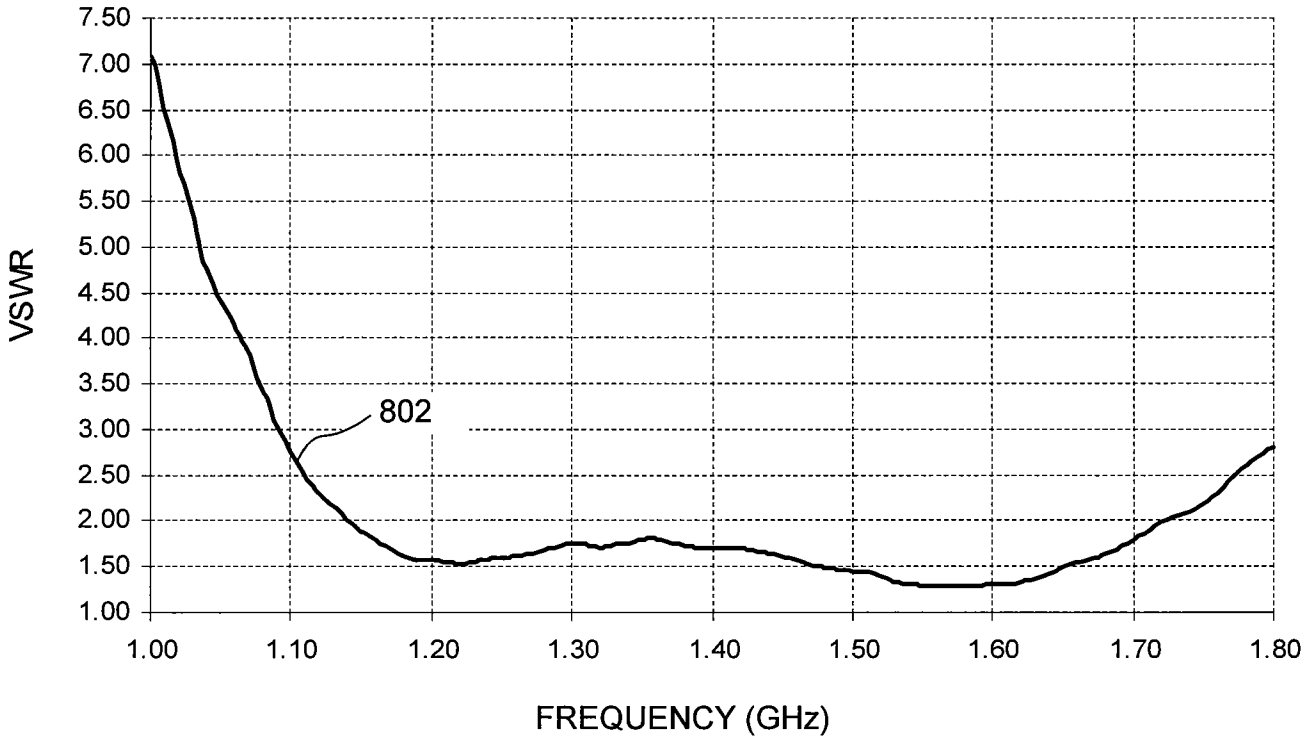
FIG. 8 shows a plot of VSWR as a function of frequency.

FIG. 8 shows a plot 802, determined from experimental measurements, of the dependence of the voltage standing wave ratio (VSWR) (vertical axis) on frequency (horizontal axis), for an embodiment of the invention. The antenna design provides operation over the 1150-1730 MHz frequency range with VSWR≤2.

In an embodiment of the antenna, as shown in FIG. 9A and FIG. 9B, the following parameters and their corresponding dimensions are used:

$r_0$ 901 is the radius of radiator 904. The value $r_0$ is user-specified depending on the required characteristics of the antenna. In one embodiment, the value of $r_0$ is about 0.1λ-0.3λ where λ is the signal wavelength at the center of the operating bandwidth range (for example, 1150-1730 MHz).

r 903 is the radius of the excitation source (such as source 1080) from the axis of symmetry (shown as z-axis 106). See also FIG. 10C. In one embodiment, the value r=26 mm+/−2 mm is used (this value is equivalent to about 0.125λ). If r is greater than this value, impedance mismatching occurs, and the bandwidth on the level of VSWR=2 at the coupler output (wave resistance 50 ohm) decreases.

h 905 is the height of the patch 910 over the flat conducting ground plane 902. In one embodiment, the value h=20 mm+/−2 mm (0.096λ) is used. If h is greater than 22 mm, the bandwidth on the level VSWR=2 is divided into two bands. At frequencies between these ranges, VSWR is less than 2, and improper antenna operation within the whole bandwidth results. As h decreases, the bandwidth on the level VSWR=2 becomes narrower.

D 907 is the characteristic linear dimension of the exciter patch 910 (see FIG. 9D-FIG. 9F). In one embodiment, the exciter patch has a circular shape with diameter D=40 mm+/−10 mm (0.192λ). As D increases, the bandwidth on the level VSWR=2 decreases, and the whole frequency range is shifted down. For D greater than 50 mm (0.24λ), the bandwidth sharply decreases due to increased capacitive coupling between the exciter patch 910 and conducting segments on the radiator 904. As the diameter D decreases, the bandwidth on the level VSWR=2 changes slightly. For D less than 30 mm (0.144λ), the bandwidth on the level VSWR=2 is divided into two bands. At medium frequencies (about 1400 MHz), VSWR is worse (greater than 2).

s 909 is the width of a conductor along the edges of PCB 920 and PCB 922. See also FIG. 10C. In one embodiment, s≤~h/2.

Figure 12:
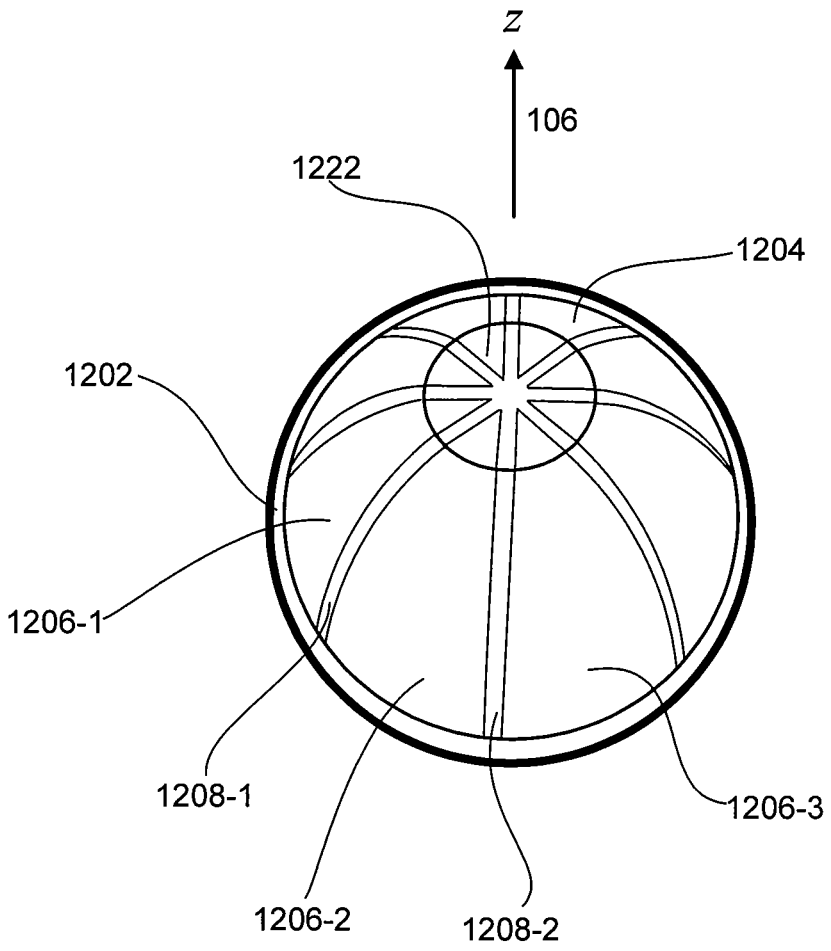
FIG. 12 shows an embodiment of a circularly-polarized antenna with a circular ground plane.

FIG. 12 shows an embodiment of an antenna similar to the one shown previously in FIG. 2A. The antenna includes a circularly-polarized radiator 1204 over a flat, circularly-shaped conducting ground plane 1202. The circularly-polarized radiator 1204 is formed from a dielectric substrate shaped as a hollow hemispherical dome truncated with a closed top planar region 1222. A set of N conducting segments, separated by a set of dielectric elements, are attached to or formed on the dielectric substrate. Shown in FIG. 12 are three representative conducting segments 1206-1, 1206-2, and 1206-3 separated by dielectric elements 1208-1 and 1208-2. In this example, the dielectric elements 1208-1 and 1208-2 are regions of the dielectric substrate.

In general, the shape of the ground plane is user-specified. For example, it may be a circle, a square, or a regular polygon with M-sides, where M is an integer greater than or equal to three. If the ground plane is sufficiently large, it does not need to be symmetric, and may have an arbitrary shape.

Figure 13:
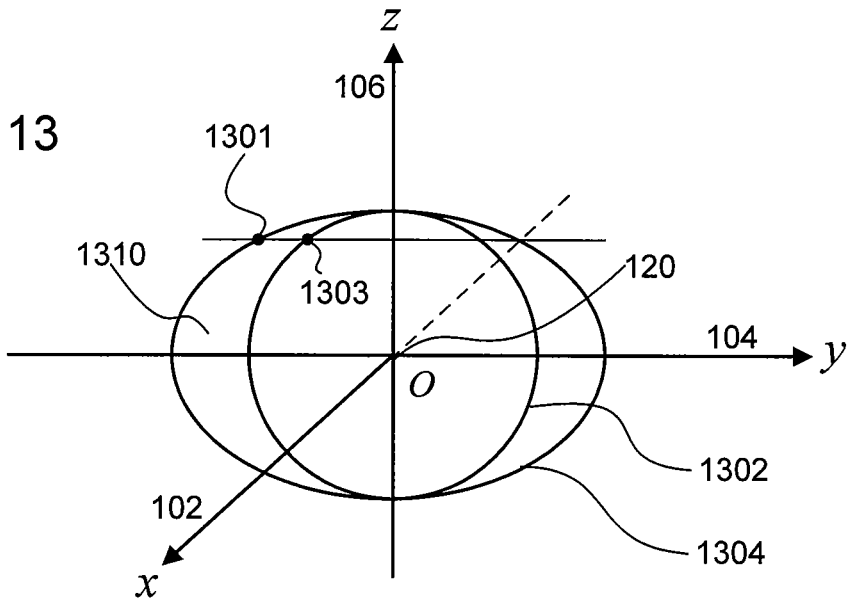
FIG. 13 shows the geometry of segments defined by a sphere and an ellipse.
Figure 14:
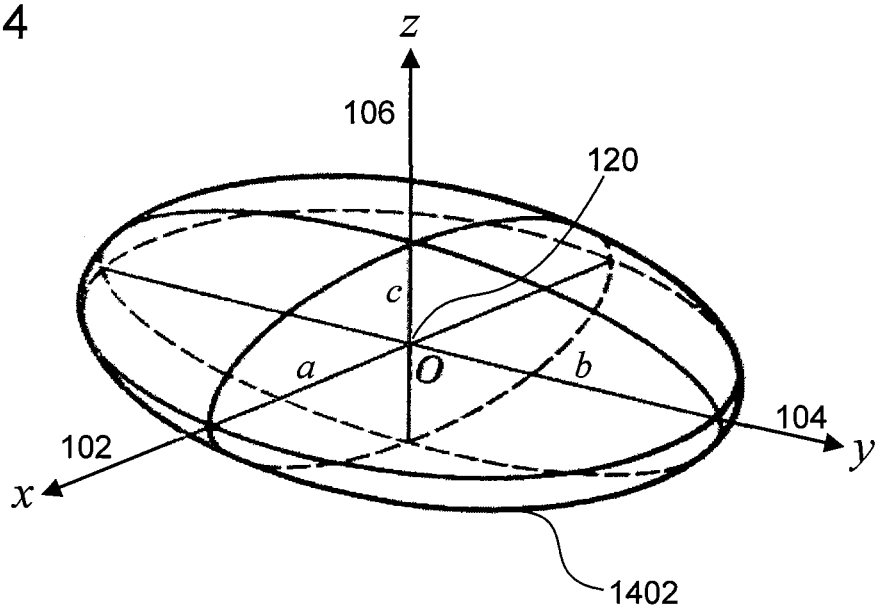
FIG. 14 shows the reference geometry for an ellipsoid.
Figure 15:
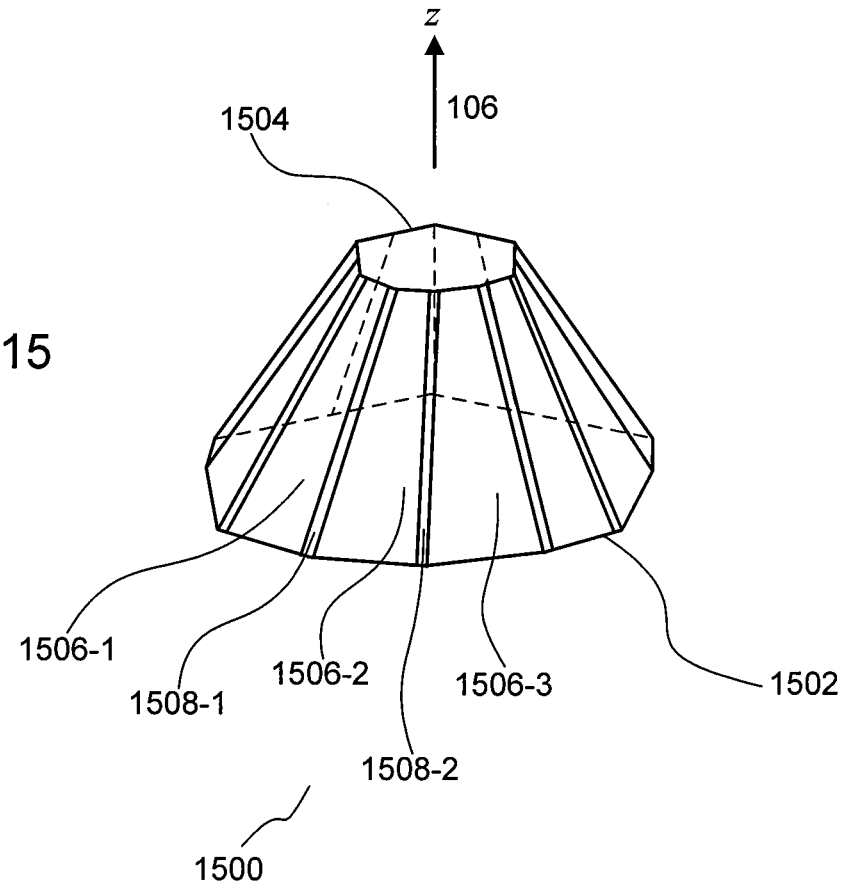
FIG. 15 shows an embodiment of a radiator with the geometry of a prism.

FIG. 13-FIG. 15 show additional examples of shapes for a circularly-polarized radiator. In FIG. 13, a circularly-polarized radiator is formed from segments of a convex surface delimited by three-dimensional zone 1310, which is located in space between a sphere 1302 of a specified radius inscribed in an external ellipsoid 1304 (which may be a sphere, see below) with a common center O 120. The convex surface can be truncated by a line leg $P_d$ 1301-$P_e$ 1303 to form a region for configuring an auxiliary radiator 908 (see FIG. 9A and FIG. 9B).

In the embodiment shown in FIG. 14, the shape of the circularly-polarized radiator is an ellipsoid 1402. The canonical equation of an ellipsoid in the Cartesian coordinate system defined by the x-axis 102, y-axis 104, and z-axis 106, with the origin O 120, is:

$$\frac{x^2}{a^2} + \frac{y^2}{b^2} + \frac{z^2}{c^2} = 1, \tag{E18}$$

where a, b, and c are the lengths of the semi-axes along the x, y, and z directions, respectively. By varying the parameters a, b, and c, different forms of the surface may be generated. If a=b=c, the surface is a hemisphere. The hemisphere may be truncated, as previously shown in FIG. 2. A semi-ellipsoid may be formed by truncating the ellipsoid; for example, by slicing the ellipsoid 1402 along the x-y plane.

In another embodiment of the invention, the surface of a segment is planar. In this case, the circularly-polarized radiator is configured as a polyhedron with N segments. FIG. 15 shows a perspective view of a circularly-polarized radiator 1500, with N=12 segments. The geometrical form is a regular truncated pyramid. The base 1502 and the base 1504 are regular polygons. Each face is an isoceles trapezoid. Faces 1506-1, 1506-2, and 1506-3 are three representative conducting segments separated by dielectric segments 1508-1 and 1508-2. Other planar shapes (for example, triangles) may be used for the faces.

One skilled in the art may develop other embodiments of the invention using other geometrical shapes for the circularly-polarized radiator. In conventional microstrip antennas with an air dielectric, the resonant size of the radiating element is typically about 0.4-0.5λ, and the bandwidth of the microstrip antenna is about 3-10% of the central frequency (depending on the spacing between the radiating element and the ground plane). Embodiments of the invention operate in a non-resonant mode. The size of the exciter patch of the excitation system is about 0.15-0.25λ; that is, it is much smaller than the resonant size. The non-resonant mode of the exciter enables the radiating system to operate within a significantly wider bandwidth relative to a conventional microstrip antenna. Antennas designed according to embodiments of the invention provide high azimuth uniformity of the antenna pattern by using a set of N radiator segments. A bandwidth of about 40% of the central frequency range is achieved. In embodiments of the invention, a simple excitation system is used to excite the radiator segments.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. A circularly-polarized antenna comprising:
a conducting ground plane;
a radiator comprising a plurality of conducting segments, wherein the plurality of conducting segments are:
separated from each other by a first dielectric medium;
separated from the ground plane by a second dielectric medium;
disposed on a surface of a hollow dome; and
symmetrically disposed about an antenna axis of symmetry orthogonal to the ground plane;
an excitation system disposed between the ground plane and the radiator and disposed at least in part within the hollow dome, wherein the excitation system is electromagnetically coupled to the radiator, wherein the excitation system comprises:
a conducting exciter patch;
a first excitation source;
a second excitation source;
a third excitation source; and
a fourth excitation source;
wherein:
the first excitation source, the second excitation source, the third excitation source, and the fourth excitation source are symmetrically disposed about the antenna axis of symmetry;
the phase difference between the second excitation source and the first excitation source is 90 degrees;
the phase difference between the third excitation source and the first excitation source is 180 degrees; and
the phase difference between the fourth excitation source and the first excitation source is 270 degrees;
a first printed circuit board comprising a first rectangular region having a first side, a second side, a first edge, a second edge, a third edge, a fourth edge, and a first board axis of symmetry, wherein:
the first edge and the second edge are parallel;
the third edge and the fourth edge are parallel;
the first edge and the third edge are perpendicular;
the first edge is parallel to the ground plane;
the third edge is orthogonal to the ground plane; and
the first board axis of symmetry is perpendicular to the first edge and intersects the center of the first edge; and
a second printed circuit board comprising a second rectangular region having a third side, a fourth side, a fifth edge, a sixth edge, a seventh edge, an eighth edge, and a second board axis of symmetry, wherein:
the fifth edge and the sixth edge are parallel;
the seventh edge and the eighth edge are parallel;
the fifth edge and the seventh edge are perpendicular;
the fifth edge is parallel to the ground plane;
the seventh edge is orthogonal to the ground plane; and
the second board axis of symmetry is perpendicular to the fifth edge and intersects the center of the fifth edge;
wherein:
the first printed circuit board is orthogonal to the second printed circuit board;
the first board axis of symmetry is coincident with the antenna axis of symmetry; and
the second board axis of symmetry is coincident with the antenna axis of symmetry.

2. The circularly-polarized antenna of claim 1, wherein:
the number of conducting segments in the plurality of conducting segments is an integer ranging from 3 to 16.

3. The circularly-polarized antenna of claim 1, wherein:
the shape of each conducting segment in the plurality of conducting segments is a portion of a convex surface.

4. The circularly-polarized antenna of claim 3, wherein:
the convex surface comprises the surface of a semi-ellipsoid.

5. The circularly-polarized antenna of claim 3, wherein:
the convex surface comprises the surface of a hemisphere.

6. The circularly-polarized antenna of claim 3, wherein:
the convex surface is bounded by a first surface of a first hemisphere having a first radius and a second surface of a second hemisphere having a second radius, wherein the first hemisphere and the second hemisphere are concentric.

7. The circularly-polarized antenna of claim 6, wherein:
the convex surface is truncated.

8. The circularly-polarized antenna of claim 1, wherein:
the shape of each conducting segment in the plurality of conducting segments is a portion of a planar figure.

9. The circularly-polarized antenna of claim 8, wherein:
the planar figure is a triangle.

10. The circularly-polarized antenna of claim 8, wherein: the planar figure is a trapezoid.

11. The circularly-polarized antenna of claim 1, further comprising:

a dielectric substrate on which the plurality of conducting segments are disposed.

12. The circularly-polarized antenna of claim 11, wherein: there is a gap between the dielectric substrate and the ground plane.

13. The circularly-polarized antenna of claim 11, wherein: the dielectric substrate is in contact with the ground plane.

14. The circularly-polarized antenna of claim 1, further comprising:

an auxiliary radiator separated from the radiator by a third dielectric medium, wherein the auxiliary radiator is configured to operate with circularly-polarized radiation.

15. The circularly-polarized antenna of claim 1, further comprising:

a plurality of dielectric spacers, wherein each dielectric spacer in the plurality of dielectric spacers is disposed between the ground plane and a corresponding conducting segment selected from the plurality of conducting segments.

16. The circularly-polarized antenna of claim 1, wherein:

the first dielectric medium is an air dielectric or a solid dielectric; and the second dielectric medium is an air dielectric or a combination of an air dielectric and a solid dielectric.

17. The circularly-polarized antenna of claim 1, wherein the shape of the ground plane is one of:

a circle;

a square; and a regular polygon.

18. The circularly-polarized antenna of claim 1, wherein the shape of the exciter patch is one of:

a circle;

a square; and a regular polygon.

19. The circularly-polarized antenna of claim 18, wherein: the exciter patch has a characteristic linear dimension ranging from about 0.15-0.25 times a signal wavelength.

20. The circularly-polarized antenna of claim 1, wherein:

the first printed circuit board further comprises first metallization on the first side, the first metallization comprising:

a first conductor having a first width along the first edge, terminating in a first electrode at the third edge and terminating in a second electrode at the fourth edge;

a second conductor having a second width along the second edge, terminating in a third electrode at the third edge;

a third conductor having a third width along the second edge, terminating in a fourth electrode at the fourth edge; and a first bridge connecting the first conductor, the second conductor, and the third conductor;

wherein:

the first electrode and the third electrode are separated by a first gap; and the second electrode and the fourth electrode are separated by a second gap;

and the second printed circuit board further comprises second metallization on the third side, the second metallization comprising:

a fourth conductor having a fourth width along the fifth edge, terminating in a fifth electrode at the seventh edge and terminating in a sixth electrode at the eighth edge;

a fifth conductor having a fifth width along the sixth edge, terminating in a seventh electrode at the seventh edge; and a sixth conductor having a sixth width along the sixth edge, terminating in an eighth electrode at the eighth edge; and a second bridge connecting the fourth conductor, the fifth conductor, and the sixth conductor;

wherein:

the fifth electrode and the seventh electrode are separated by a third gap; and the sixth electrode and the eighth electrode are separated by a fourth gap.

21. The circularly-polarized antenna of claim 20, wherein:

the first excitation source comprises the first electrode and the third electrode separated by the first gap;

the second excitation source comprises the fifth electrode and the seventh electrode separated by the third gap;

the third excitation source comprises the second electrode and the fourth electrode separated by the second gap; and the fourth excitation source comprises the sixth electrode and the eighth electrode separated by the fourth gap.

22. The circularly-polarized antenna of claim 20, wherein:

the first printed circuit board further comprises a first power coupler on the second side, the first power coupler comprising:

a first microstrip line having a first line-width, a first line-length, and a wave resistance W, wherein the first microstrip line is divided into:

a second microstrip line having a second line-width, a second line-length, and a wave resistance 2W; and a third microstrip line having a third line-width, a third line-length, and a wave resistance 2W;

and the second printed circuit board further comprises a second power coupler on the fourth side, the second power coupler comprising:

a fourth microstrip line having a fourth line-width, a fourth line-length, and a wave resistance W, wherein the fourth microstrip line is divided into:

a fifth microstrip line having a fifth line-width, a fifth line-length, and a wave resistance 2W; and a sixth microstrip line having a sixth line-width, a sixth line-length, and a wave resistance 2W.

23. The circularly-polarized antenna of claim 22, wherein:

the second microstrip line terminates at the third electrode through a first metallized hole;

the third microstrip line terminates at the second electrode through a second metallized hole;

the fifth microstrip line terminates at the sixth electrode through a third metallized hole; and the sixth microstrip line terminates at the seventh electrode through a fourth metallized hole.

24. The circularly-polarized antenna of claim 23, further comprising a quadrature coupler, the quadrature coupler comprising:

an input connected to a feeder from at least one of a receiver and a transmitter;

a first output connected to the first microstrip line; and a second output connected to the fourth microstrip line.

25. The circularly-polarized antenna of claim 24, wherein:
the first excitation source comprises the first electrode and the third electrode separated by the first gap;
the second excitation source comprises the fifth electrode and the seventh electrode separated by the third gap;
the third excitation source comprises the second electrode and the fourth electrode separated by the second gap; and
the fourth excitation source comprises the sixth electrode and the eighth electrode separated by the fourth gap.

26. The circularly-polarized antenna of claim 24, wherein:
the quadrature coupler is mounted on a third printed circuit board; and
the third printed circuit board is mounted on the ground plane.

27. The circularly-polarized antenna of claim 22, wherein:
the second microstrip line terminates in a first pad capacitively coupled to the third electrode;
the third microstrip line terminates in a second pad capacitively coupled to the second electrode;
the fifth microstrip line terminates in a third pad capacitively coupled to the sixth electrode; and
the sixth microstrip line terminates in a fourth pad capacitively coupled to the seventh electrode.

28. The circularly-polarized antenna of claim 27, further comprising a quadrature coupler, the quadrature coupler comprising:
an input connected to a feeder from at least one of a receiver and a transmitter;
a first output connected to the first microstrip line; and
a second output connected to the fourth microstrip line.

29. The circularly-polarized antenna of claim 28, wherein:
the first excitation source comprises the first electrode and the third electrode separated by the first gap;
the second excitation source comprises the fifth electrode and the seventh electrode separated by the third gap;
the third excitation source comprises the second electrode and the fourth electrode separated by the second gap; and
the fourth excitation source comprises the sixth electrode and the eighth electrode separated by the fourth gap.

30. The circularly-polarized antenna of claim 28, wherein:
the quadrature coupler is mounted on a third printed circuit board; and
the third printed circuit board is mounted on the ground plane.

31. An excitation system for a circularly-polarized antenna comprising:
a conducting exciter patch configured to be electromagnetically coupled to a radiator;
a first excitation source;
a second excitation source;
a third excitation source; and
a fourth excitation source;
wherein:
the first excitation source, the second excitation source, the third excitation source, and the fourth excitation source are symmetrically disposed about a system axis of symmetry orthogonal to the exciter patch;
the phase difference between the second excitation source and the first excitation source is 90 degrees;
the phase difference between the third excitation source and the first excitation source is 180 degrees; and
the phase difference between the fourth excitation source and the first excitation source is 270 degrees;
a first printed circuit board comprising a first rectangular region having a first side, a second side, a first edge, a second edge, a third edge, a fourth edge, and a first board axis of symmetry, wherein:
the first edge and the second edge are parallel;
the third edge and the fourth edge are parallel;
the first edge and the third edge are perpendicular;
the first edge is parallel to the exciter patch;
the third edge is orthogonal to the exciter patch; and
the first board axis of symmetry is perpendicular to the first edge and intersects the center of the first edge; and
a second printed circuit board comprising a second rectangular region having a third side, a fourth side, a fifth edge, a sixth edge, a seventh edge, an eighth edge, and a second board axis of symmetry, wherein:
the fifth edge and the sixth edge are parallel;
the seventh edge and the eighth edge are parallel;
the fifth edge and the seventh edge are perpendicular;
the fifth edge is parallel to the exciter patch;
the seventh edge is orthogonal to the exciter patch; and
the second board axis of symmetry is perpendicular to the fifth edge and intersects the center of the fifth edge;
wherein:
the first printed circuit board is orthogonal to the second printed circuit board;
the first board axis of symmetry is coincident with the system axis of symmetry; and
the second board axis of symmetry is coincident with the system axis of symmetry.

32. The excitation system of claim 31, wherein the shape of the exciter patch is one of:
a circle;
a square; and
a regular polygon.

33. The excitation system of claim 31, wherein:
the exciter patch has a characteristic linear dimension ranging from about 0.15-0.25 times a signal wavelength.

34. The excitation system of claim 31, wherein:
the first printed circuit board further comprises first metallization on the first side, the first metallization comprising:
a first conductor having a first width along the first edge, terminating in a first electrode at the third edge and terminating in a second electrode at the fourth edge;
a second conductor having a second width along the second edge, terminating in a third electrode at the third edge;
a third conductor having a third width along the second edge, terminating in a fourth electrode at the fourth edge; and
a first bridge connecting the first conductor, the second conductor, and the third conductor;
wherein:
the first electrode and the third electrode are separated by a first gap; and
the second electrode and the fourth electrode are separated by a second gap;
and
the second printed circuit board further comprises second metallization on the third side, the second metallization comprising:
a fourth conductor having a fourth width along the fifth edge, terminating in a fifth electrode at the seventh edge and terminating in a sixth electrode at the eighth edge;

a fifth conductor having a fifth width along the sixth edge, terminating in a seventh electrode at the seventh edge; and a sixth conductor having a sixth width along the sixth edge, terminating in an eighth electrode at the eighth edge; and a second bridge connecting the fourth conductor, the fifth conductor, and the sixth conductor;

wherein:

the fifth electrode and the seventh electrode are separated by a third gap; and the sixth electrode and the eighth electrode are separated by a fourth gap.

35. The excitation system of claim 34, wherein:

the first excitation source comprises the first electrode and the third electrode separated by the first gap;

the second excitation source comprises the fifth electrode and the seventh electrode separated by the third gap;

the third excitation source comprises the second electrode and the fourth electrode separated by the second gap; and the fourth excitation source comprises the sixth electrode and the eighth electrode separated by the fourth gap.

36. The excitation system of claim 34, wherein:

the first printed circuit board further comprises a first power coupler on the second side, the first power coupler comprising:

a first microstrip line having a first line-width, a first line-length, and a wave resistance W, wherein the first microstrip line is divided into:

a second microstrip line having a second line-width, a second line-length, and a wave resistance 2W; and a third microstrip line having a third line-width, a third line-length, and a wave resistance 2W;

and the second printed circuit board further comprises a second power coupler on the fourth side, the second power coupler comprising:

a fourth microstrip line having a fourth line-width, a fourth line-length, and a wave resistance W, wherein the fourth microstrip line is divided into:

a fifth microstrip line having a fifth line-width, a fifth line-length, and a wave resistance 2W; and a sixth microstrip line having a sixth line-width, a sixth line-length, and a wave resistance 2W.

37. The excitation system of claim 36, wherein:

the second microstrip line terminates at the third electrode through a first metallized hole;

the third microstrip line terminates at the second electrode through a second metallized hole;

the fifth microstrip line terminates at the sixth electrode through a third metallized hole; and the sixth microstrip line terminates at the seventh electrode through a fourth metallized hole.

38. The excitation system of claim 37, further comprising a quadrature coupler, the quadrature coupler comprising:

an input connected to a feeder from at least one of a receiver and a transmitter;

a first output connected to the first microstrip line; and a second output connected to the fourth microstrip line.

39. The excitation system of claim 38, wherein:

the first excitation source comprises the first electrode and the third electrode separated by the first gap;

the second excitation source comprises the fifth electrode and the seventh electrode separated by the third gap;

the third excitation source comprises the second electrode and the fourth electrode separated by the second gap; and the fourth excitation source comprises the sixth electrode and the eighth electrode separated by the fourth gap.

40. The excitation system of claim 38, wherein:

the quadrature coupler is mounted on a third printed circuit board.

41. The excitation system of claim 36, wherein:

the second microstrip line terminates in a first pad capacitively coupled to the third electrode;

the third microstrip line terminates in a second pad capacitively coupled to the second electrode;

the fifth microstrip line terminates in a third pad capacitively coupled to the sixth electrode; and the sixth microstrip line terminates in a fourth pad capacitively coupled to the seventh electrode.

42. The excitation system of claim 41, further comprising a quadrature coupler, the quadrature coupler comprising:

an input connected to a feeder from at least one of a receiver and a transmitter;

a first output connected to the first microstrip line; and a second output connected to the fourth microstrip line.

43. The excitation system of claim 42, wherein:

the first excitation source comprises the first electrode and the third electrode separated by the first gap;

the second excitation source comprises the fifth electrode and the seventh electrode separated by the third gap;

the third excitation source comprises the second electrode and the fourth electrode separated by the second gap; and the fourth excitation source comprises the sixth electrode and the eighth electrode separated by the fourth gap.

44. The excitation system of claim 42, wherein:

the quadrature coupler is mounted on a third printed circuit board.

* * * * *